US008752943B2

(12) United States Patent
Hirano et al.

(10) Patent No.: US 8,752,943 B2
(45) Date of Patent: Jun. 17, 2014

(54) LIQUID CARTRIDGE

(75) Inventors: Mikio Hirano, Obu (JP); Noritsugu Ito, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 137 days.

(21) Appl. No.: 13/016,860

(22) Filed: Jan. 28, 2011

(65) Prior Publication Data

US 2011/0242233 A1 Oct. 6, 2011

(30) Foreign Application Priority Data

Jan. 29, 2010 (JP) ..... 2010-019333

(51) Int. Cl.
*B41J 2/175* (2006.01)

(52) U.S. Cl.
USPC ..... 347/86

(58) Field of Classification Search
None
See application file for complete search history.

(56) References Cited

U.S. PATENT DOCUMENTS

| | | | |
|---|---|---|---|
| 4,476,472 | A | 10/1984 | Aiba et al. |
| 5,929,884 | A | 7/1999 | Hetzer et al. |
| 5,963,237 | A | 10/1999 | Ikkatai et al. |
| 5,988,802 | A | 11/1999 | Pawlowski, Jr. et al. |
| 6,022,102 | A | 2/2000 | Ikkatai et al. |
| 6,161,920 | A | 12/2000 | Santhanam et al. |
| 6,164,743 | A | 12/2000 | Hmelar et al. |
| 6,293,662 | B1 | 9/2001 | Shihoh et al. |
| 6,332,676 | B1 | 12/2001 | Santhanam |
| 6,378,971 | B1 | 4/2002 | Tamura et al. |
| RE37,874 | E | 10/2002 | Pawlowski, Jr. et al. |
| 6,457,805 | B2 | 10/2002 | Ohtani et al. |
| 6,767,075 | B1 | 7/2004 | Takada et al. |
| 2001/0024225 | A1 | 9/2001 | Ishizawa et al. |
| 2002/0024543 | A1 | 2/2002 | Kimura et al. |
| 2002/0089576 | A1 | 7/2002 | Ishizawa et al. |
| 2002/0196317 | A1 | 12/2002 | Santhanam et al. |
| 2003/0071874 | A1 | 4/2003 | Ishizawa et al. |
| 2004/0201652 | A1 | 10/2004 | Katayama |
| 2004/0252146 | A1 | 12/2004 | Naka et al. |
| 2005/0068382 | A1 | 3/2005 | Kimura et al. |
| 2005/0134663 | A1 | 6/2005 | Sasaki et al. |
| 2005/0146577 | A1 | 7/2005 | Sasaki et al. |
| 2005/0146578 | A1 | 7/2005 | Takagi et al. |
| 2005/0146579 | A1 | 7/2005 | Sasaki et al. |

(Continued)

FOREIGN PATENT DOCUMENTS

| | | | |
|---|---|---|---|
| EP | 0799703 | A2 | 10/1997 |
| EP | 0803364 | A2 | 10/1997 |

(Continued)

OTHER PUBLICATIONS

United States Patent and Trademark Office, Non-Final Office Action for U.S. Appl. No. 13/016,615 (related U.S. patent application), mailed Dec. 21, 2012.

(Continued)

*Primary Examiner* — Stephen Meier
*Assistant Examiner* — Renee I Wilson
(74) *Attorney, Agent, or Firm* — Baker Botts L.L.P.

(57) ABSTRACT

A liquid cartridge includes a liquid storing portion that stores liquid therein, a detection portion in fluid communication with the liquid storing portion, a movable member that is disposed in the detection portion, and a sensor that outputs a signal relative to a position of the movable member.

35 Claims, 15 Drawing Sheets

(56) References Cited

U.S. PATENT DOCUMENTS

| | | | | |
|---|---|---|---|---|
| 2005/0151812 | A1 | 7/2005 | Sasaki et al. | |
| 2005/0195225 | A1 | 9/2005 | Takagi et al. | |
| 2005/0212874 | A1 | 9/2005 | Nomura et al. | |
| 2006/0007283 | A1 | 1/2006 | Sacco, Jr. et al. | |
| 2007/0008368 | A1 | 1/2007 | Maru et al. | |
| 2007/0222829 | A1 | 9/2007 | Stathem | |
| 2007/0229618 | A1 | 10/2007 | Sugahara | |
| 2008/0231676 | A1 | 9/2008 | Shimizu | |
| 2008/0259145 | A1 | 10/2008 | Nomura et al. | |
| 2008/0273048 | A1 | 11/2008 | Naka et al. | |
| 2008/0303879 | A1 | 12/2008 | Nip | |
| 2009/0021565 | A1 | 1/2009 | Hattori | |
| 2009/0085942 | A1 | 4/2009 | Asauchi | |
| 2009/0096849 | A1 | 4/2009 | Kanbe et al. | |
| 2009/0141106 | A1 | 6/2009 | Takagi | |
| 2009/0237426 | A1 | 9/2009 | Kimura | |
| 2009/0244166 | A1 | 10/2009 | Sugahara | |
| 2010/0079513 | A1 | 4/2010 | Taira et al. | |
| 2010/0155417 | A1 | 6/2010 | Utzui et al. | |
| 2010/0220127 | A1 | 9/2010 | Levy et al. | |
| 2010/0238241 | A1 | 9/2010 | Sasaki | |
| 2011/0000935 | A1 | 1/2011 | Iwamuro et al. | |
| 2011/0141167 | A1* | 6/2011 | Kikkawa et al. | 347/6 |
| 2011/0187772 | A1 | 8/2011 | Tomoguchi et al. | |
| 2011/0249065 | A1 | 10/2011 | Hirano et al. | |
| 2012/0069068 | A1 | 3/2012 | Ito et al. | |
| 2012/0075392 | A1 | 3/2012 | Shirono et al. | |
| 2013/0027480 | A1 | 1/2013 | Otobe | |

FOREIGN PATENT DOCUMENTS

| | | | |
|---|---|---|---|
| EP | 0826505 | A2 | 3/1998 |
| EP | 1053881 | A1 | 11/2000 |
| EP | 1060895 | A1 | 12/2000 |
| EP | 1114725 | A2 | 7/2001 |
| EP | 1153752 | A2 | 11/2001 |
| EP | 1164025 | A1 | 12/2001 |
| EP | 1241011 | A2 | 9/2002 |
| EP | 1285764 | A1 | 2/2003 |
| EP | 1462263 | A2 | 9/2004 |
| EP | 1466739 | A1 | 10/2004 |
| EP | 1609604 | A1 | 12/2005 |
| EP | 1839876 | A1 | 10/2007 |
| EP | 2095961 | A1 | 9/2009 |
| EP | 2105306 | A2 | 9/2009 |
| EP | 2202078 | A1 | 6/2010 |
| EP | 2272675 | A2 | 1/2011 |
| GB | 2312283 | A | 10/1997 |
| JP | S60-092861 | A | 5/1985 |
| JP | H08-080618 | A | 3/1996 |
| JP | H11-286123 | A | 10/1999 |
| JP | 2005-238815 | A | 9/2005 |
| JP | 2005-306005 | A | 11/2005 |
| JP | 2010-017926 | A | 1/2010 |
| JP | 2010-069807 | A | 4/2010 |
| JP | 2010-076301 | A | 4/2010 |
| WO | 2005075204 | A1 | 8/2005 |
| WO | 2008-117882 | A1 | 10/2008 |

OTHER PUBLICATIONS

International Bureau of WIPO, International Preliminary Report on Patentability for International Application No. PCT/JP2011/052305 (counterpart International patent application), mailed Aug. 9, 2012.

European Patent Office, extended European Search Report for European Patent Application No. 11152574.7 (counterpart European patent application), dated Jun. 29, 2011.

European Patent Office, partial European Search Report for European Patent Application No. 11152574.7 (counterpart European patent application), dated Mar. 1, 2011.

Japan Patent Office, International Search Report for International Patent Application No. PCT/JP2011/052305 (counterpart International patent application), mailed Apr. 5, 2011.

Japan Patent Office, Written Opinion of the International Searching Authority for International Patent Application No. PCT/JP2011/052305 (counterpart International patent application), mailed Apr. 5, 2011.

United States Patent and Trademark Office, Office Action for U.S. Appl. No. 13/016,615 (counterpart U.S. patent application), mailed Feb. 14, 2013.

International Searching Authority, International Search Report and Written Opinion for PCT Application No. PCT/JP2011/052304 (Counterpart PCT Application), mailed Apr. 5, 2011.

European Patent Office, Extended European Search Report for European Patent Application No. 11152604.2 (counterpart to above-captioned patent application), dated Mar. 4, 2011.

European Patent Office, Partial European Search Report for European Patent Application No. 11152591.1 (counterpart to above-captioned patent application), dated Mar. 4, 2011.

European Patent Office, extended European Search Report for European Patent Application No. 11152591.1 (counterpart European patent application), dated Jun. 30, 2011.

European Patent Office, Extended European Search Report for European Patent Application No. 11152574.7 (related to above-captioned patent application), mailed Jun. 29, 2011.

European Patent Office, Extended European Search Report for European Patent Application No. 11737232.6 (related to above-captioned patent application), mailed Oct. 7, 2013.

European Patent Office, Extended European Search Report for European Patent Application No. 11737231.8 (related to above-captioned patent application), mailed Oct. 7, 2013.

State Intellectual Property Office of the People's Republic of China, Notification of First Office Action for Chinese Patent Application No. 201110035993.2 (related to above-captioned patent application), mailed Jan. 9, 2014.

State Intellectual Property Office of the People's Republic of China, Notification of First Office Action for Chinese Patent Application No. 201110036033.8 (related to above-captioned patent application), mailed Jan. 13, 2014.

* cited by examiner

LIQUID CARTRIDGE

CROSS REFERENCE TO RELATED APPLICATION

This application claims priority to Japanese Patent Application No. 2010-019333, filed Jan. 29, 2010, the entire subject matter and disclosure of which is incorporated herein by reference.

BACKGROUND OF THE INVENTION

1. Field of the Invention

The present invention relates to a liquid cartridge.

2. Description of Related Art

A recording apparatus has a main unit and an ink cartridge configured to be mounted to the main unit. The recording apparatus has a sensor for the recording apparatus to determine completion of mounting of an ink cartridge to the main unit of the recording apparatus. Specifically, when the ink cartridge is mounted to a mounting portion of the main unit of the recording apparatus, a pair of resistors provided on a surface of the ink cartridge comes into contact with a pair of electrodes provided at the mounting portion, respectively, whereby the pair of electrodes is electrically connected to each other via the pair of resistors, which enables the determination that the ink cartridge is mounted in the mounting portion.

However, although the mounting of the ink cartridge to the mounting portion can be determined by the detection of the electric connection between the electrodes, it is not determined whether a hollow tube of the main unit has been inserted into an ink outlet path of the ink cartridge completely. Accordingly, it is not determined whether an ink path extending from the ink cartridge to the main unit has been formed.

SUMMARY OF THE INVENTION

Therefore, a need has arisen for a liquid cartridge which overcomes these and other shortcomings of the related art. A technical advantage of the present invention is that it is possible to determine whether a hollow tube of a main unit has been inserted into a liquid outlet path of a liquid cartridge.

In an embodiment of the invention, a liquid cartridge comprises a liquid storing portion configured to store liquid therein, a liquid outlet path configured to be in fluid communication with the liquid storing portion, a movable member disposed in the liquid outlet path; and a sensor configured to output a signal relative to a position of the movable member. The liquid outlet path is configured to allow liquid to flow therethrough in a liquid flow direction. The movable member is configured to move from a first position to a second position in a direction parallel to the liquid flow direction.

In another embodiment of the invention, a liquid cartridge comprises a liquid storing portion configured to store liquid therein, a liquid outlet tube defining a liquid outlet path therein, wherein the liquid outlet path is configured to be in fluid communication with the liquid storing portion, a movable member configured to slide along an inner wall of the liquid outlet tube in the liquid outlet path; and a sensor configured to output a signal relative to a position of the movable member.

In yet another embodiment of the invention, a liquid cartridge comprises a liquid storing portion configured to store liquid therein, a detection portion configured to be in fluid communication with the liquid storing portion, a particular valve configured to selectively place an interior of the liquid storing portion and an exterior of the liquid storing portion in fluid communication, a movable member disposed at the detection portion; and a sensor configured to output a signal relative to a position of the movable member.

In still another embodiment of the invention, a liquid cartridge comprises a liquid storing portion configured to store liquid therein, a detection portion configured to be in fluid communication with the liquid storing portion, a movable member disposed in the detection portion a sensor configured to output a signal relative to a position of the movable member; and a biasing member disposed at the detection portion and configured to bias the movable member.

In still yet another embodiment of the invention, a liquid cartridge comprises a liquid storing portion configured to store liquid therein, a liquid outlet path configured to be in fluid communication with the liquid storing portion, a movable member disposed in the liquid outlet path; and a sensor configured to output a signal relative to a position of the movable member. The movable member is configured to move from a first position to a second position in a first direction, and to move from the second position to the first position in a second direction parallel to the first direction.

In still yet another embodiment of the invention, a liquid cartridge comprises a liquid storing portion configured to store liquid therein, a liquid outlet path configured to place an interior of the liquid storing portion in fluid communication with an exterior of the liquid storing portion, a movable valve member disposed at the liquid outlet path and configured to selectively move between an open position and a closed position; and a sensor configured to output a signal relative to a position of the movable valve member. When the movable valve member is in the closed position, the movable valve member is configured to prevent fluid communication between the interior of the liquid storing portion and the exterior of the liquid storing portion.

In still yet another embodiment of the invention, a liquid cartridge comprises a liquid storing portion configured to store liquid therein, a detection portion configured to be in fluid communication with the liquid storing portion, a movable member disposed in the detection portion, a sensor configured to output a signal relative to a position of the movable member; and a contact portion electrically connected to the sensor.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DETAILED DESCRIPTION OF EMBODIMENTS OF THE INVENTION

Embodiments of the present invention, and their features and advantages, may be understood by referring to FIGS. 1-13, like numerals being used for like corresponding parts in the various drawings.

Figure 1:
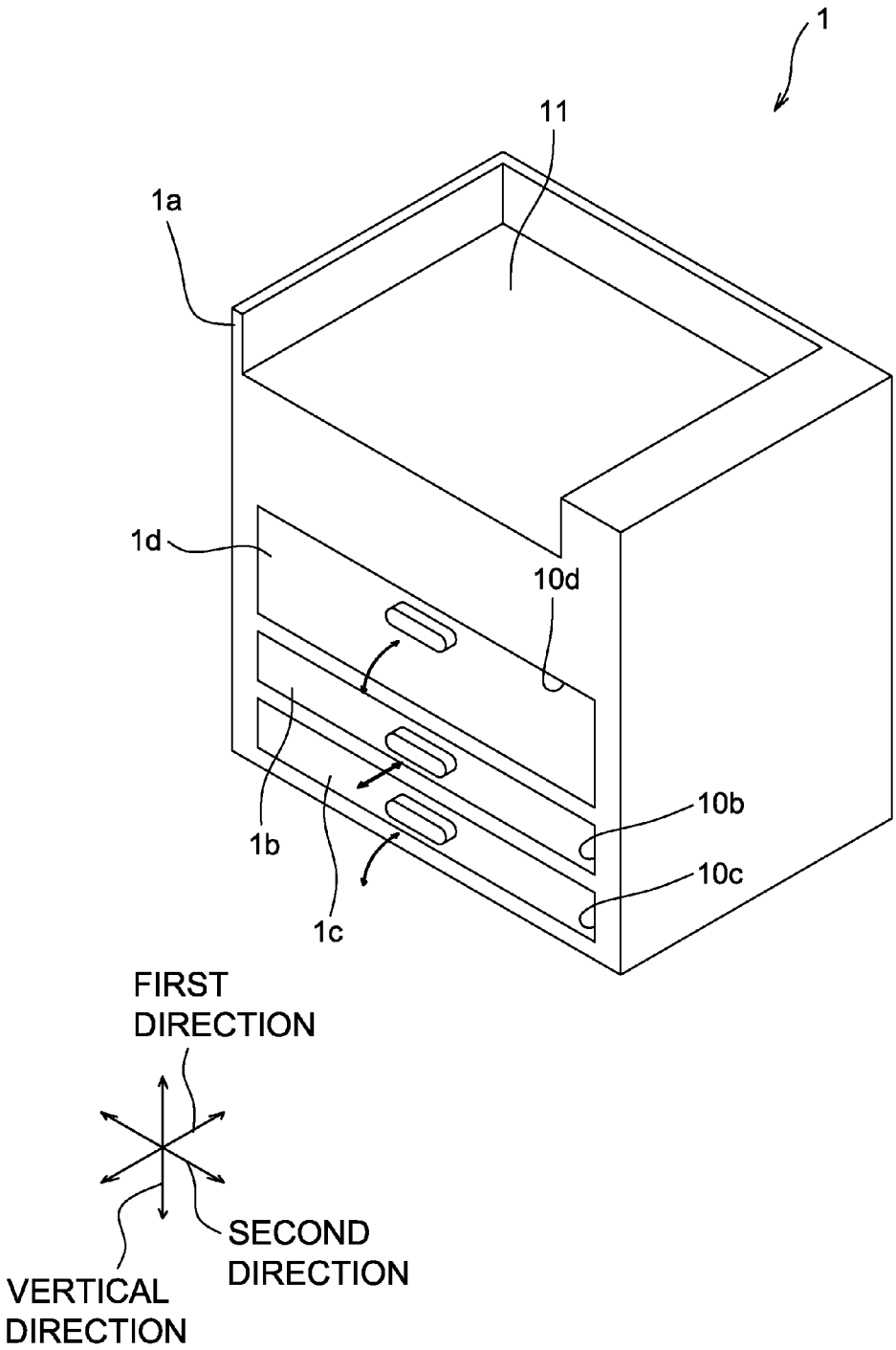
FIG. 1 is a perspective view of an ink jet printer comprising an ink cartridge according to an embodiment of the invention.
Figure 2:
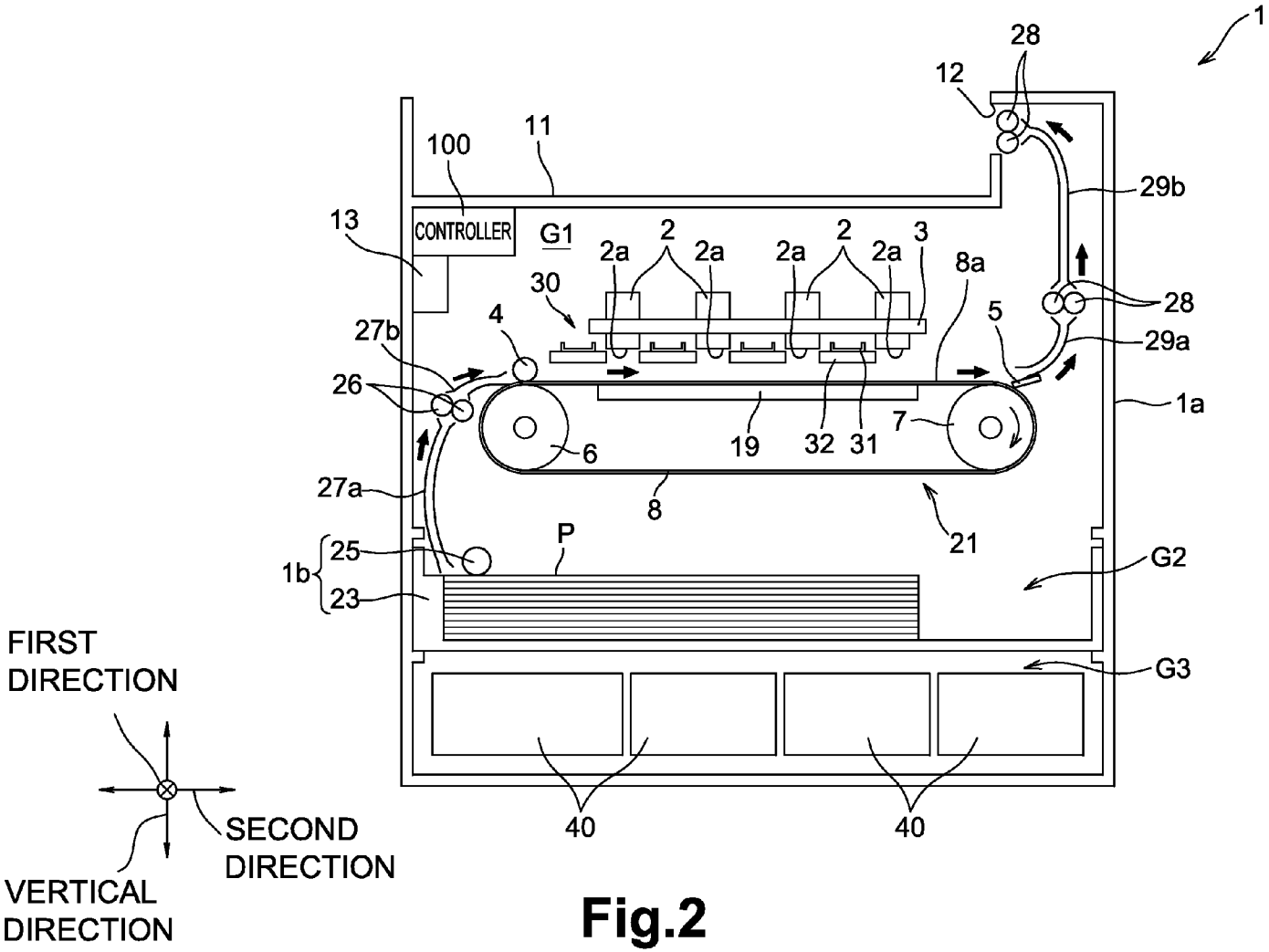
FIG. 2 is a schematic side view of the internal structure of the ink jet printer of FIG. 1.

Referring to FIGS. 1 and 2, in an embodiment of the invention, an ink jet printer 1 may comprise a main unit and at least one ink cartridge 40 configured to be mounted to the main unit. The main unit of the ink jet printer 1 may comprise a housing 1*a* having substantially a rectangular parallelepiped shape. The housing 1*a* may have three openings 10*d*, 10*b*, and 10*c* formed in one of its vertically extending outer faces. The openings 10*d*, 10*b*, and 10*c* may be substantially vertically aligned in this order from above. The main unit of the ink jet printer 1 further may comprise doors 1*d* and 1*c* fitted into the openings 10*d* and 10*c*, respectively. Each of the doors 1*d* and 1*c* may be configured to pivot about a horizontal axis at its lower end. When the doors 1*d* and 1*c* are pivoted to be opened and closed, the openings 10*d* and 10*c* are covered and uncovered, respectively. The main unit of the ink jet printer 1 may comprise a sheet feed unit 1*b* inserted into the opening 10*b*. A sheet discharge portion 31 may be disposed at the top of the housing 1*a*. As shown in FIG. 2, the door 1*d* may be disposed such that door 1*d* faces a transporting unit 21 in a first direction, e.g., a primary direction.

Referring to FIG. 2, the interior of the housing 1*a* of the ink jet printer 1 may be divided into three spaces G1, G2, and G3 in the vertical direction in this order from above. A plurality of, e.g., four, ink jet heads 2, a maintenance unit 30, and the transporting unit 21 are disposed in the space G1, and the four ink jet heads 2 may be configured to discharge inks of magenta, cyan, yellow, and black, respectively. The sheet feed unit 1*b* may be disposed in the space G2. A plurality of, e.g., four ink cartridges 40 may be disposed in the space G3.

The sheet feed unit 1*b* and four ink cartridges 40 may be configured to be mounted to and removed from the housing 1*a* in the first direction. In an embodiment, the transporting unit 21 may transport sheets in a transporting direction parallel with a second direction which is perpendicular to the first direction. Each of the first direction and the second direction is a substantially horizontal direction relative to the orientation of the ink jet printer 1. The main unit of the ink jet printer 1 may comprise a controller 100 configured to control the sheet feed unit 1*b*, transporting unit 21, and ink jet heads 2. Each of the four ink jet heads 2 may extend in the first direction, and the four ink jet heads 2 may be arrayed in the second direction.

The four ink jet heads 3 may be supported by the housing 1*a*, specifically by a frame 3. The dimension, e.g., length, of each ink jet head 2 in the first direction is greater than the dimension, e.g., the length of a sheet P in the first direction. In an embodiment of the invention, the ink jet printer 1 may be a so-called line printer. The frame 3 may be configured to vertically move by an elevator mechanism (not shown) disposed in the housing 1*a*. The elevator mechanism may move the frame, such that the ink jet heads 2 may move between a printing position, e.g., the position shown in FIG. 2, and a retracted position, e.g., as shown in FIG. 4. Controller 100 may control the elevator mechanism to move the frame 3 and ink jet heads 2.

Figure 7A:
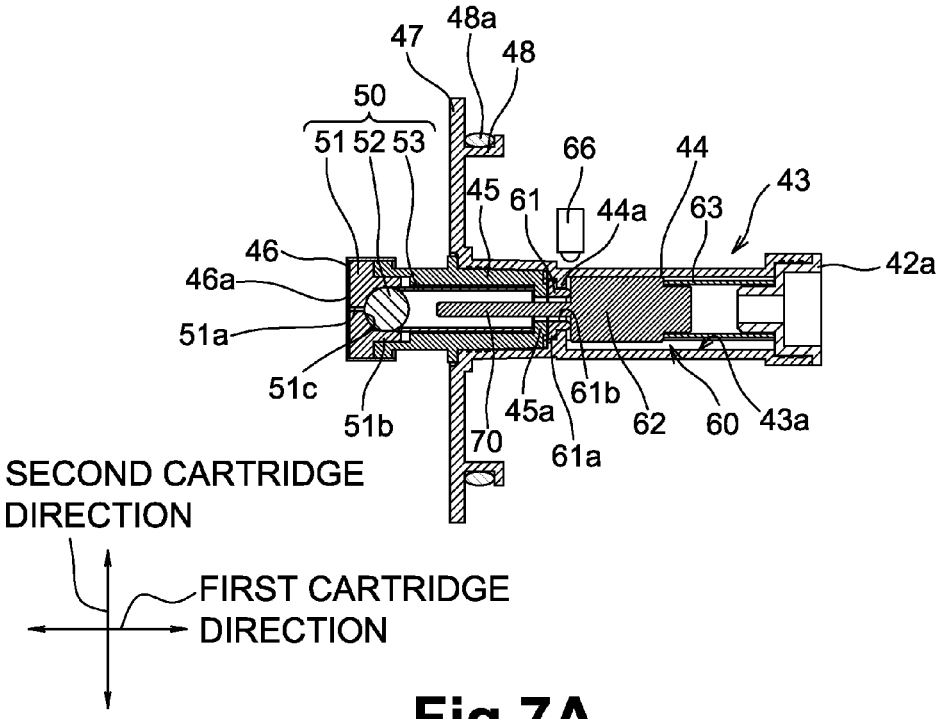
FIG. 7A is a partial horizontal cross-sectional view of the ink cartridge of FIG. 5, in which each of a first valve and a second valve is in a closed state, according to an embodiment of the invention.
Figure 7B:
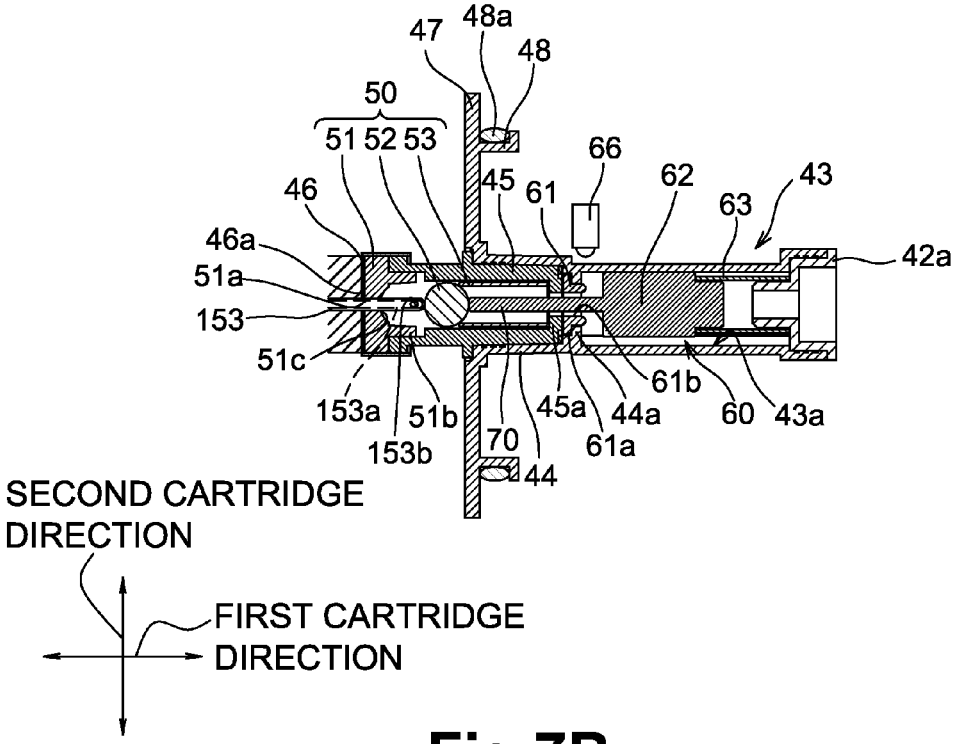
FIG. 7B is a partial horizontal cross-sectional view of the ink cartridge of FIG. 5, in which each the first valve and the second valve is in an open state, according to an embodiment of the invention.

Each ink jet head 2 may have a layered structure comprising a path unit not shown) in which ink paths including pressure chambers are formed, and an actuator unit (not shown) placed on the path unit. The actuator unit may be configured to selectively apply pressure to ink in the pressure chambers. The bottom surface of each ink jet head 2 has a discharge surface 2*a*, where multiple discharge nozzles (not shown) for discharging ink may be formed. Each ink jet head 2 may be connected with a flexible tube (not shown), such that the interior of the ink jet head 2 may be in fluid communication with the inner path of the flexible tube. As shown in FIGS. 7A and 7B, Each flexible tube may be connected to a mounting portion 150, such that the inner path of the flexible tube may be in fluid communication with an ink supply path 154 formed in the mounting portion 150.

A sheet transport path along which sheets P are transported is formed in the housing 1*a* of ink jet printer 1. The sheet transport path may extend from the sheet feed unit 1*b* toward the sheet discharge portion 31, as shown by the bold arrows in FIG. 2. The sheet feed unit 1*b* may comprise a sheet feed tray 23 and a sheet feed roller 25 attached to the sheet feed tray 23 configured to store multiple sheets P. Controller 100 may control a sheet feed motor not shown) to drive the sheet feed roller 25, which may be configured to feed out the topmost sheet P in the sheet feed tray 23. The sheet P fed out from the sheet feed roller 25 may be nipped by a feed roller pair 26, and may be sent to the transporting unit 21 while being guided by guides 27*a* and 27*b*

Referring to FIG. 2, the transporting unit 21 may comprise two belt rollers 6 and 7, and an endless transport belt 8 wound around the belt rollers 6 and 7. The belt roller 7 may be a driving roller configured to rotate in the clockwise direction, when oriented as shown in FIG. 2, when a shaft thereof is driven by a transport motor not shown) controlled by the controller 100. The belt roller 6 may be a driven roller configured to rotate in the clockwise direction, when oriented as shown in FIG. 2, due to the force applied from operation of the transport belt 8 caused by the rotation of the belt roller 7.

An outer surface 8*a* of the transport belt 8 may be subjected to silicone processing, so that the outer surface 8*a* may have adhesive properties. A nip roller 4 may be disposed above the belt roller 6, sandwiching the transport belt 8 therebetween on the sheet transport path. The nip roller 4 may be configured to press the sheet P fed out from the sheet feed unit 1*b* against the outer surface 8*a* of the transport belt 8. The sheet pressed against the outer surface 8*a* may be held on the outer surface 8*a* by the adhesive properties thereof, and may be transported toward the right side, when ink jet printer 1 is disposed as shown in FIG. 2.

A separating plate 5 may be disposed above the belt roller 7, with the transport belt 8 disposed between separating plate 5 and the belt roller 7 on the sheet transport path. The separating plate 5 may be configured to separate the sheet P, which is held on the outer surface 8*a* of the transport belt 8, from the outer surface 8*a*. After the sheet P has been separated, the sheet P may be transported by being guided by guides 29*a* and 29*b* and nipped by two feed roller pairs 28. Then, sheet P may be discharged to the discharge portion 11 from an opening 12 formed through the housing 1*a*. One roller of each feed roller pair 28 may be driven by a feed motor (not shown) controlled by the controller 100.

A platen 19 may have substantially a rectangular parallelepiped shape, and may be is disposed within the loop of the transport belt 8. The platen 19 may overlap with the four ink jet heads 2 in the vertical direction. The upper surface of the platen 19 may be in contact with the inner surface of the transport belt 8 at an upper portion of the loop of the transport belt 8, and the platen 19 may support the transport belt 8 from the interior of transport belt 8. Accordingly, the outer surface 8*a* of the transport belt 8 at the upper portion of the loop thereof may face the discharge surfaces 2*a* of the ink jet heads 2, and may extend in parallel with the discharge surfaces 2*a*. A slight gap may be formed between the discharge surfaces 2*a* and the outer surface 8*a*, and the sheet transport path may extend through this gap. When the sheet P held on the outer surface 8*a* of the transport belt 8 passes immediately below the four ink jet heads 2, ink of each color may be discharged toward the upper surface of the sheet P from a corresponding one of the ink jet heads 2 under control of the controller 100, thereby forming a desired color image on the sheet P.

Of the four ink cartridges 40, the ink cartridge 40 at the leftmost position in FIG. 2 may store black ink. In an embodiment of the invention, the ink cartridge 40 storing black ink may have a greater size, as compared to the other three ink cartridges 40. Specifically, in an embodiment of the invention, the ink cartridge 40 that stores black ink may extend further in the second direction than the other ink cartridges 40. The ink cartridge 40 at the leftmost position may have a greater ink capacity than the other three ink cartridges 40. The other three ink cartridges 40 may have substantially the same ink capacity, and may store magenta, cyan, and yellow inks, respectively.

When the four ink cartridges 40 are mounted in the housing 1*a*, the interior of an ink bag 42 (described later) of each ink cartridge 40 may be placed in fluid communication with the ink supply path 154, shown in FIGS. 9A and 9B, which may be in fluid communication with the interior of a corresponding one of the ink jet heads 2. Thus, ink stored in the ink bag 42 may be supplied to the ink jet head 2 via ink supply path 154. The maintenance unit 30 may comprise a plurality of pumps (not shown) for forcibly feeding ink from the ink cartridges 40 to the ink jet heads 2 under control of the controller 100. The pumps may be connected to the flexible tubes between the ink jet heads 2 and the mounting portions 150, respectively.

When the ink cartridge 40 is intended to be replaced, the door 1*c* may be opened and the ink cartridge 40 may be removed from the housing 1*a* via the opening 10. A new ink cartridge 40 may be mounted in to the housing 1*a* via the opening 10*e*. In an embodiment, the ink cartridges 40 are configured to be individually mounted into the housing 1*a*, but in another embodiment, the four ink cartridges 40 may be loaded on a single cartridge tray to form an integral unit, and the unit may be mounted into the housing 1*a*.

Referring to FIG. 2, the maintenance unit 30 may be disposed between the four ink jet heads 2 and the transporting unit 21. In an embodiment of the invention, the maintenance unit 30 is configured to eliminate faulty ink discharge from the ink jet heads 2 if it occurs. The maintenance unit 30 may comprise four plate-shaped members 32, which may be disposed at equally-spaced intervals in the second direction, and four caps 31 which may be fixed on the plate-shaped members 32 and configured to cover the discharge surfaces 2*a* of the ink jet heads 2.

Figure 3A:
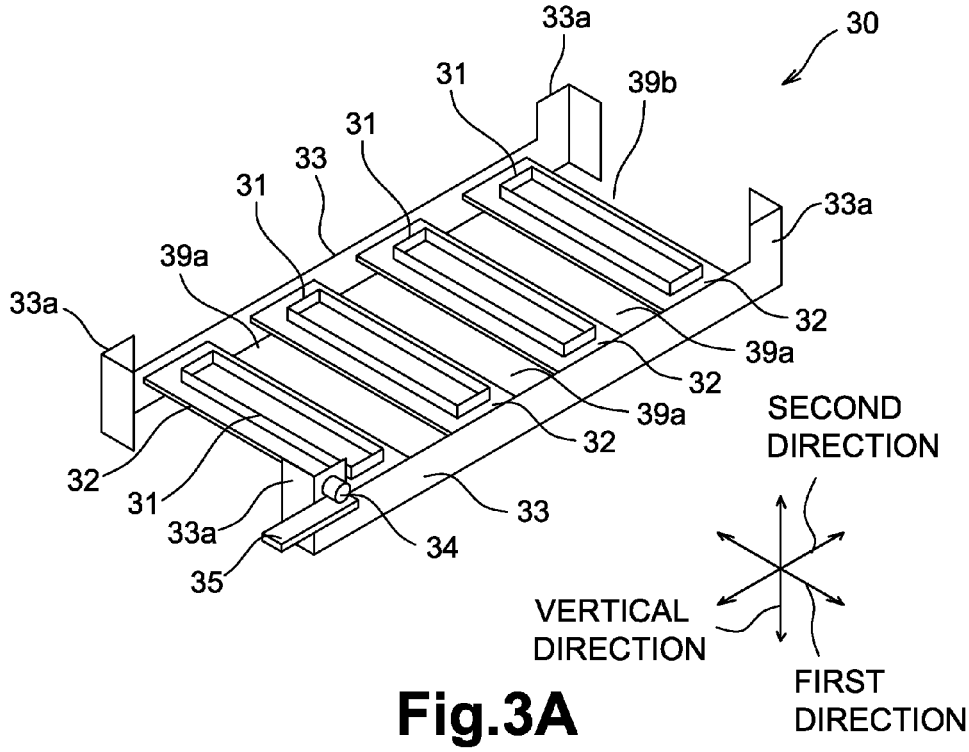
FIGS. 3A and 3B are perspective views of a maintenance unit of the ink jet printer of FIG. 1.

Referring to FIG. 3A, the dimension, e.g., the length of each cap 31 in the first direction is greater than the dimension, e.g., the width, of each cap 31 in the second direction. Similarly, although not shown in detail, the dimension, e.g., the length, of each discharge surface 2*a* in the first direction is greater than the dimension, e.g., the width, of each cap 31 in the second direction. The cap 31 may comprise an elastic material such as rubber. The rubber may have a recess formed therein, and the recess may open upwards. The four caps 31 may be disposed upstream of the corresponding ink jet heads 2 in the transporting direction, respectively, in the initial state. Specifically, the cap 31, e.g., the leftmost cap 31 when arranged as shown in FIG. 2, which is positioned at the most upstream side, of all the four caps 32, may be disposed upstream of the ink jet head 2, e.g., the left most ink jet head 2 in FIG. 2, which may be positioned at the most upstream side, of all the ink jet heads 2. Similarly, the remaining three caps 31 may be disposed between the ink jet heads 2, respectively, in the transporting direction. The four caps 31 may be configured to be moved in the vertical direction and horizontal directions relative to the corresponding ink jet heads 2, respectively, in accordance with the motion of the maintenance unit 30.

Referring to FIG. 3A, the maintenance unit 30 may comprise a pair of inner frames 33 and holding the plate-shaped members 32 therebetween. Each of the pair of inner frames 33 may comprise upward-protruding corner portions 33*a* at both ends thereof in the second direction. One corner portion 33*a* of each inner frame 33 may comprise a pinion gear 34 fixed to the shaft of a driving motor (not shown) to be controlled by the controller 100, so as to engage with a rack gear 35 extending in the second direction, e.g., the transporting direction. FIG. 3A shows one pinion gear 34 positioned at the near side in FIG. 3A.

Figure 3B:
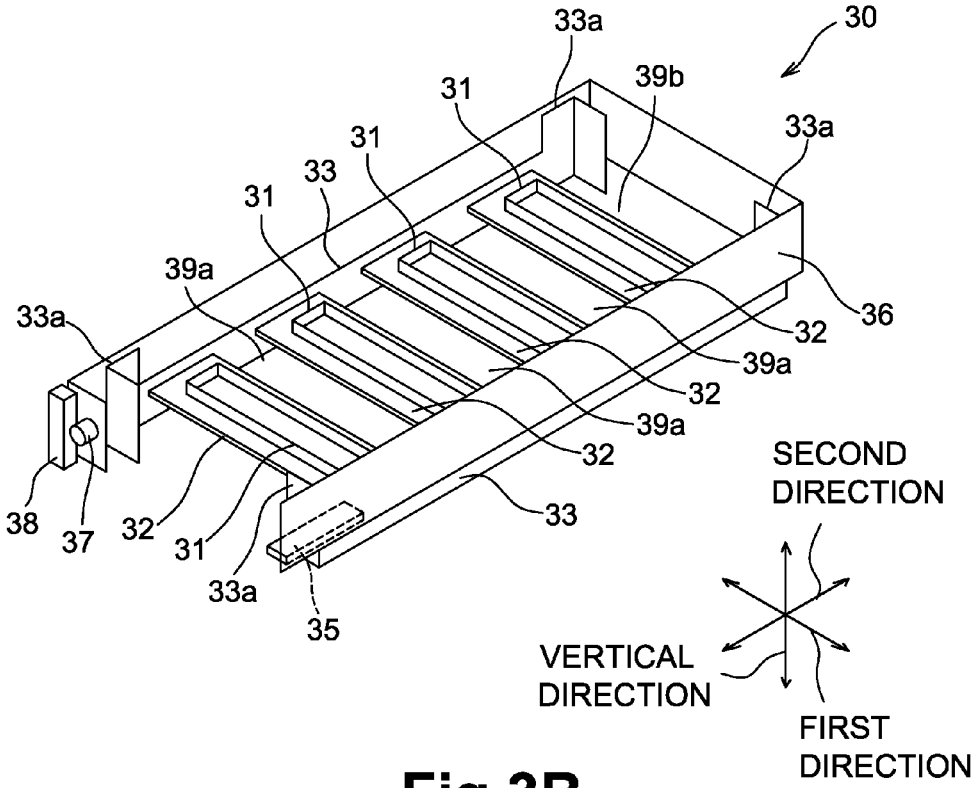

Referring to FIG. 3B, the maintenance unit 30 may comprise an outer frame 36 provided on the perimeter of the pair of the inner frames 33, and partially enclosing the pair of the inner frames 33. The rack gears 35 may be fixed on the inner surface of the outer frame 36. A pinion gear 37 fixed on a shaft of a driving motor (not shown) to be controlled by the controller 100 may be provided on the outer frame 36, so as to engage with a rack gear 38 extending in the vertical direction. The rack gear 38 may be supported by the housing 1*a*.

With this configuration, when two pinion gears 34 are rotated synchronously under control of the controller 100, the pair of inner frames 33 may move in the second direction. Also, when the controller 100 controls the pinion gear 37 to rotate, the pinion gear 37 may move outer frame 36 in the vertical direction.

Figure 4A:
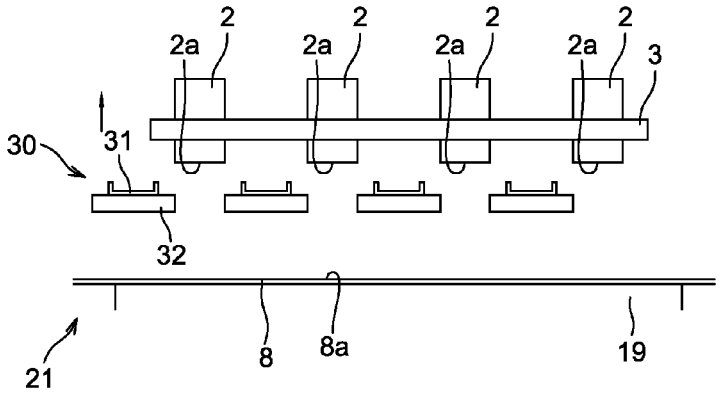
FIGS. 4A to 4C are partial side views of the ink jet printer of FIG. 1, illustrating a capping operation.

At the initial position shown in FIG. 2, the maintenance unit 30 may be positioned such that three openings 39*a* formed between the plate-shaped members 32 face three discharge surfaces 2*a* in the vertical direction, and an opening 39*b* formed between the plate-shaped member 32 positioned at the most downstream in the transporting direction and the corner portions 33*a* faces the other one of the discharge surfaces 2*a* in the vertical direction. When a capping operation covering the discharge surfaces 2*a* with the caps 31 is initiated from this initial state, the ink jet heads 2 may be moved from the printing position to the retracted position by the elevator mechanism, as shown in FIG. 4A.

Figure 4B:
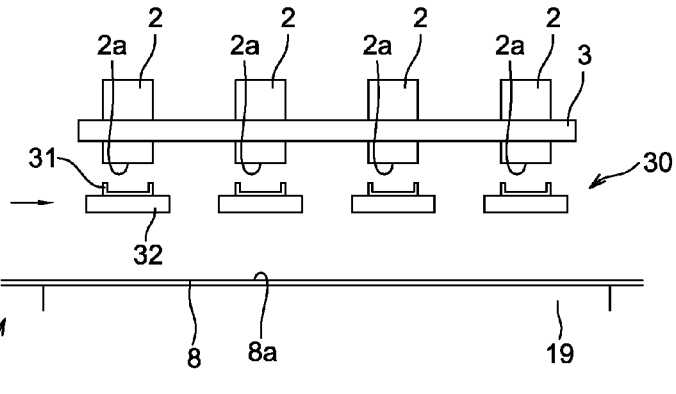
Figure 4C:
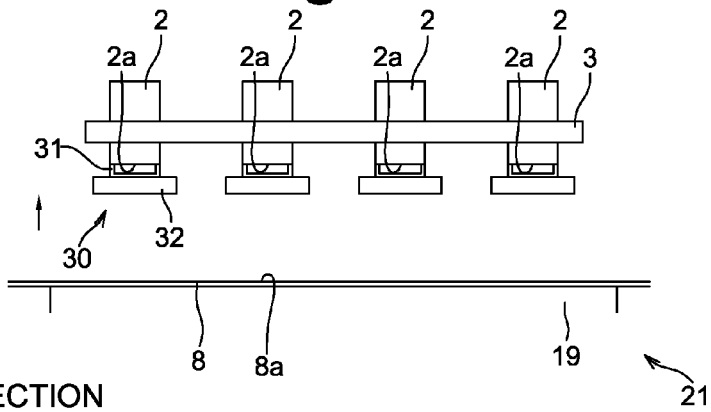
Figure 4C:
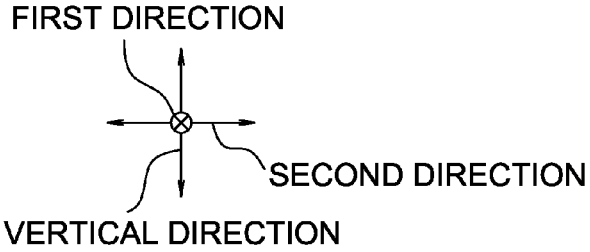

Subsequently, as shown in FIG. 4B, the pair of inner frames 33 may move to the downstream side of the transportation direction, until the caps 31 face the discharge surfaces 2*a* in the vertical direction, respectively. Subsequently, the outer frame 36 may be raised in the vertical direction, whereby the caps 31 are pressed against the discharge surfaces 2*a*, such that the caps 31 cover the discharge surfaces 2*a*, respectively, at a capping position, as shown in FIG. 4C. When the maintenance unit 30 and the ink jet head 3 reverse their previous movement, the caps 31 may return from the capping position to the initial position, and the ink jet heads 2 may return from the retracted position to the printing position.

Figure 8:
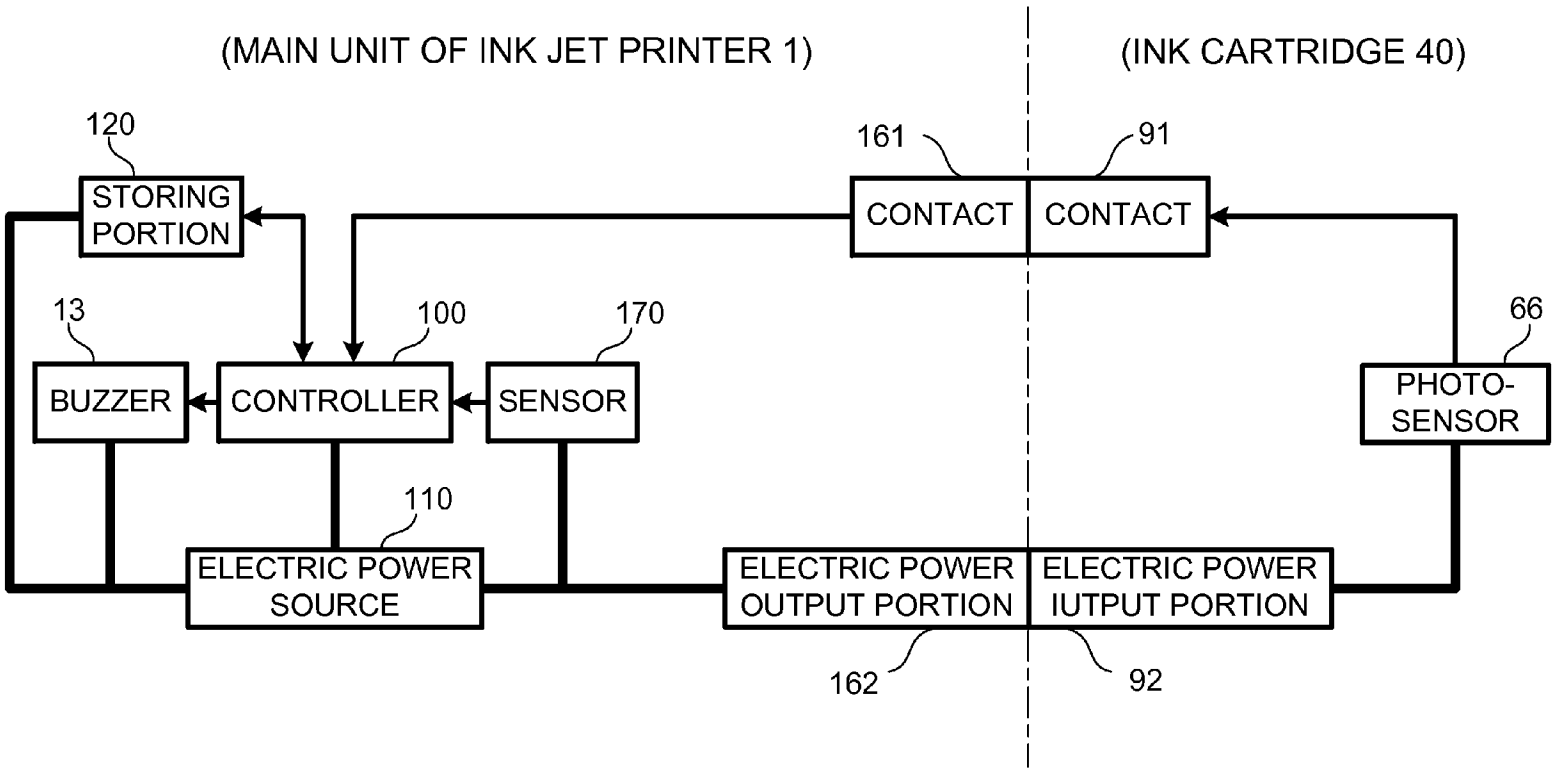
FIG. 8 is a block diagram of the electrical configuration of the ink jet printer of FIG. 1.

Referring to FIGS. 5 to 8, the ink cartridges 40 will be described. In FIG. 8, electric power supply lines are illustrated as heavy lines, and signal lines are illustrated as light lines. The ink cartridge 40 may comprise a housing 41 having substantially a rectangular parallelepiped shape, an ink bag 42, e.g., an ink storing portion, which may be disposed within the housing 41, an ink outlet tube 43, which may be connected to the ink bag 42 at one end, a first valve 50, and a second valve 60. The ink bag 42 may be configured to store ink therein.

The dimension of the housing 41*a* in a first cartridge direction, i.e., the length, may be greater than the dimension of the housing 41 in a second cartridge direction, i.e., the width, and the width of the housing 41 in the second cartridge direction is greater than the dimension of the housing in a third cartridge direction, i.e., the height. The first cartridge direction, the second cartridge direction, and the third cartridge direction are substantially perpendicular to each other. When the ink cartridge 40 is mounted in the mounting portion 150, the first cartridge direction is aligned with the first direction, the second cartridge direction is aligned with the second direction, and the third cartridge direction is aligned with the vertical direction.

Figure 6:
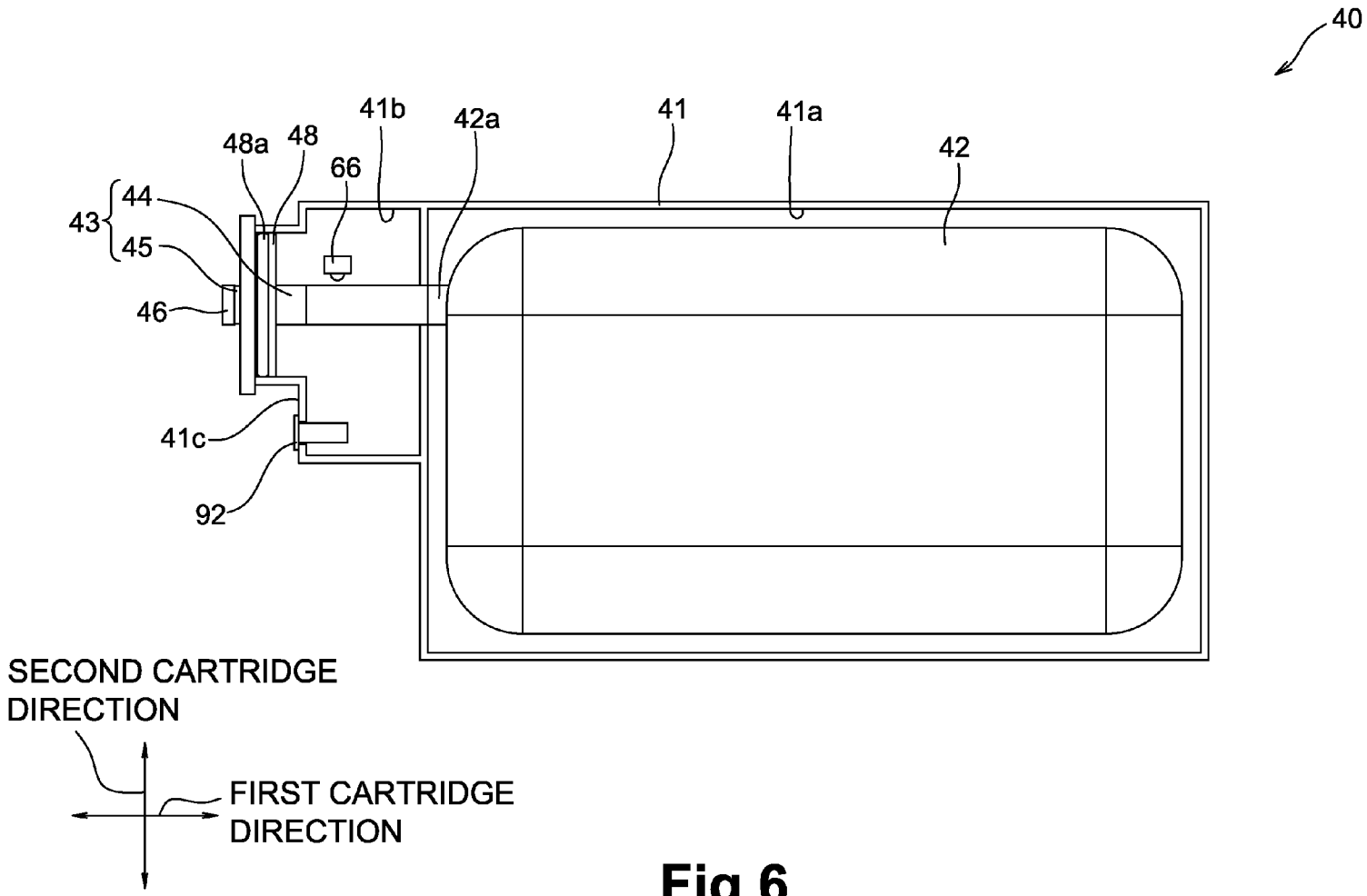
FIG. 6 is a top view of the internal structure of the ink cartridge of FIG. 5.

Referring to FIG. 6, may be divided into two chambers 41*a* and 41*b* in the first direction. The ink bag 42 may be disposed in the chamber 41*a*, which may be larger than the chamber 41*b*. The ink outlet tube 43 may be disposed in the chamber 41*b*. As described above, the ink cartridge 40 for storing black ink is greater in size and ink capacity than the other three ink cartridges 40. Nevertheless, in an embodiment of the invention, the difference between the ink cartridge 40 for storing black ink and the ink cartridges 40 for storing other types of ink is that the chamber 41*a* and ink bag 42 of the ink cartridge 40 for storing black ink are merely greater than those of the other three ink cartridges 40 in the second direction. Thus, in an embodiment, the four ink cartridges 40 have almost the same structure. Accordingly, detailed operation of only one ink cartridge 40 will be described herein.

Referring to FIGS. 6 to 7B, the ink bag 42 may be connected to a connecting portion 42*a*, such that ink stored in the ink bag 42 may be supplied to the outside of the ink bag 42 through the connecting portion 42. The ink outlet tube 43 may have has a tube 44, e.g., a cylindrical tube 44, connected to a connecting portion 42*a* at a first end thereof, and a tube 45, e.g., a cylindrical tube 45, fitted into a second end, e.g., the left end, when positioned as shown in FIGS. 7A and 7B, of the tube 44. The ink outlet tube 43 may have an ink outlet path 43*a* formed therein. More specifically, a first end of the tube 45 may be fitted into the tube 44, but a second end of the tube 45 may be positioned outside of the tube 44. The ink outlet tube 43, i.e., the tubes 44 and 45, may extend in the first direction. Accordingly, the ink outlet path 43*a* defined by the ink outlet tube 43 also may extend in the first direction. The ink outlet path 43*a* may be configured to be in fluid communication with the interior of the ink bag 42 via the connecting portion 42*a* at a first end thereof, and to be in fluid communication with the outside of the ink cartridge 40 at a second end thereof. In this embodiment, the tubes 44 and 45 each may comprise a translucent, e.g., a transparent or semi-transparent resin, such that a detector, e.g., photo-sensor 66, described in more detail further herein, may detect a valve member 62, which will be described in more detail further herein.

A ring-shaped flange 47 may be provided at the second end of the tube 44 opposite the first end of the tube 44 connected to the connecting portion 42*a*. The flange 47 may extend from an outer surface of the second end of the tube 44 in radial directions of the tube 44. A ring-shaped protrusion 48 may extend from the flange 47 toward the ink bag 42 in the first direction. An O-ring 48*a* may be fitted around the protrusion 48. The flange 47 may form at least a portion of one of walls defining the chamber 41*b*, and also may define is a portion of the housing 41. Another portion of the housing 41 is connected to the flange 47, such that the O-ring 48*a* is positioned between flange 47*a* and protrusion 48. Therefore, O-ring 48*a* may reduce the likelihood that ink may leak around the flange 47.

Figure 5:
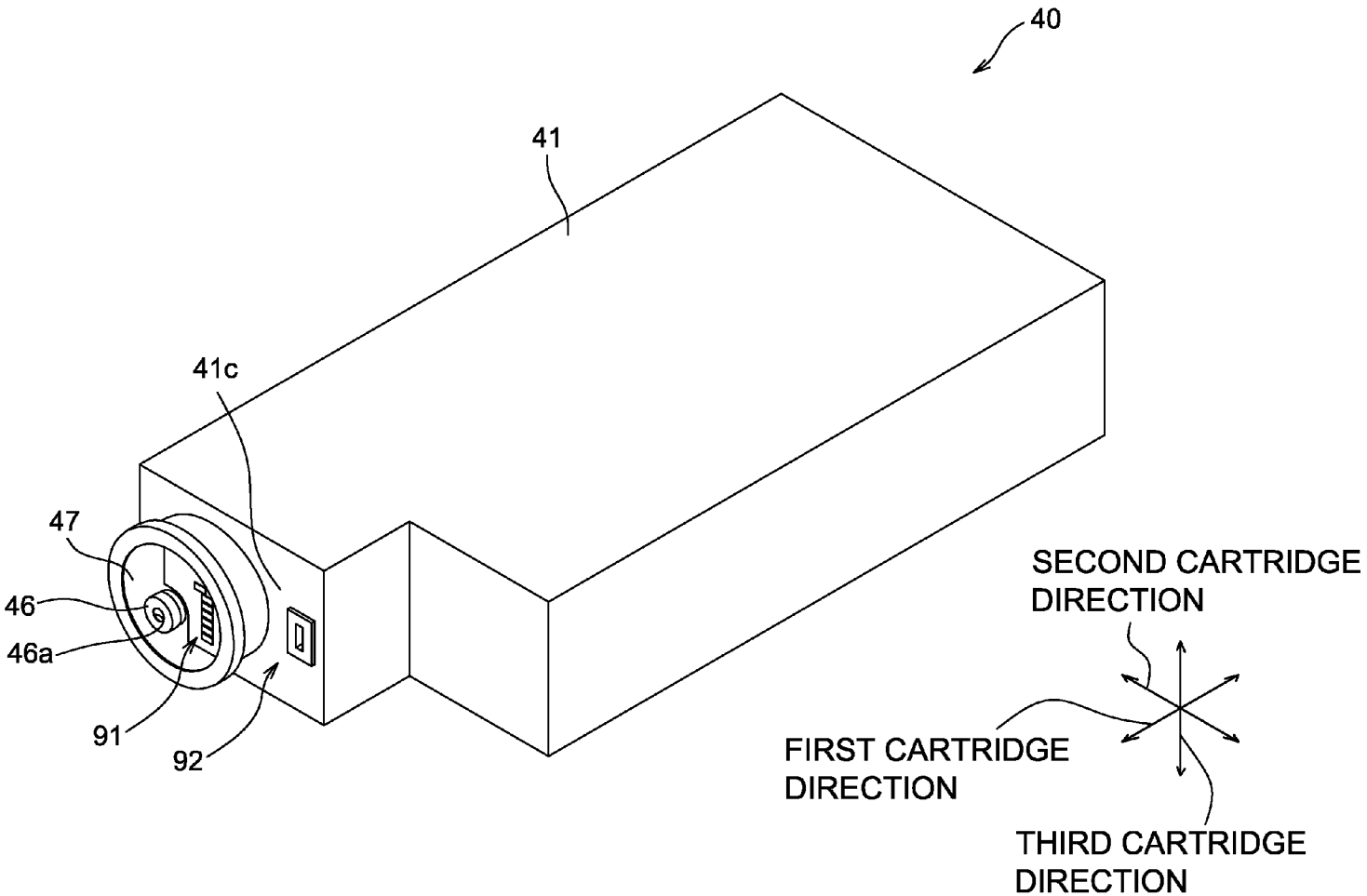
FIG. 5 is a perspective view of an ink cartridge according to an embodiment of the invention.

Referring to FIGS. 5 and 8, a contact 91 may be provided on the outer surface of the flange 47. The contact 91 may be aligned with an ink discharge opening 46*a*, which will be described in more detail herein, in the second direction. The contact 91 may be electrically connected with the photo-sensor 66. In another embodiment of the invention, the contact 91 may be disposed at any position that is not directly below the ink discharge opening 46*a* when the ink cartridge 40 is mounted to the mounting portion 150. Because the contact 91 for transmitting signal is provided so as to not be positioned directly below the ink discharge opening 46*a*, ink dripping from the ink discharge opening 46*a* may be prevented from adhering to the contact 91.

Referring to FIGS. 5, 6, and 8, the housing 41 may comprise a shoulder surface 41*c* which may be positioned away from the flange 47 toward the ink bag 42. The shoulder surface 41*c* may extend parallel with the flange 47, i.e., extending in the second direction and the third direction. An electric power input portion 92 may be provided on the shoulder surface 41*c*. The contact 91 may be positioned between the electric power input portion 92 and the ink discharge opening 46*a* in the second direction. The electric power input portion 92 may be positioned further away from the ink discharge opening 46*a* than the contact 91 is in the second direction. Also, as shown in FIG. 8, the electric power input portion 92 may be electrically connected to the photo-sensor 66. The electric power input portion 92 may be configured to supply electric power to the photo-sensor 66 when the electric power input portion 92 is electrically connected to an electric power output portion 162. In another embodiment, the electric power input portion 92 may be disposed at any position that is not directly below the ink discharge opening 46*a* when the ink cartridge 40 is mounted to the mounting portion 150. The electric power input portion 92 may have a recess formed therein configured to receive the electric power output portion 162.

Because the electric power input portion 92 for transmitting electric power is not positioned directly below the ink discharge opening 46*a*, ink dripping from the ink discharge opening 46*a* may be prevented from adhering to the electric power input portion 92. Moreover, because the electric power input portion 92 is positioned further away from the ink discharge opening 46*a* than the contact 91 is, the likelihood of ink adhesion may be further decreased. This may reduce the likelihood or prevent the electric power input portion 92 from short-circuiting and damaging the photo-sensor 66.

Because the electric power input portion 92 is provided on the shoulder surface 41*c*, and there is a distance between the electric power input portion 92 and the ink discharge opening 46*a* in the first direction, the distance between the electric power input portion 92 and the ink discharge opening 46*a* may increase not only in the second direction but also in the first direction. Accordingly, adhesion of ink to the electric power input portion 92 may further be reduced.

Referring to FIGS. 7A and 7B, the first valve 50 may be disposed at the ink outlet path 43*a* defined by the tube 45 of the ink outlet tube 43. The first valve 50 may comprise a sealing member 51 which is an elastic member positioned in the ink outlet path 43*a* and contacting the inner surface of the tube 45 to close an opening of the ink outlet path 43*a* formed at the second end of the ink outlet path 43*a*. The first valve 50 may comprise a spherical member 52, as a first valve member, which may be disposed in the ink outlet path 43*a*, and a coil spring 53, as a first biasing member, which may be disposed in the ink outlet path 43*a* defined by the tube 45. Each of the diameter of the spherical member 52 and the diameter of the coil spring 53 may be less than the diameter of the ink outlet path 43*a* defined by the tube 45. A lid 46 may be attached to the second end of the tube 45, such that the sealing member 51 may maintain attachment to the tube 45. An ink discharge opening 46*a* may be formed through the lid 46.

The coil spring 53 may extend in the first direction, and one end of the coil spring 53 may be in contact with the spherical member 52. The other end of the coil spring 53 may be in contact with a platform portion 45*a*, which may be located at the first end of the tube 45. The coil spring 53 may be configured to apply a constant biasing force to bias the spherical member 52 toward the sealing member 51. In an embodiment, the coil spring 53 is used as a biasing member. Nevertheless, in other embodiments, any suitable biasing member which can bias the spherical member 52 toward the sealing member 51 may be used.

The sealing member 51 may comprise an elastic material, such as rubber or the like. The sealing member 51 may have an opening 51*a* formed therethrough, and the opening 51*a* may extend in the first direction at the middle of the sealing member 51. The sealing member 51 may comprise a ring-shaped protrusion 51*b* fitted into the second end of the tube 45, such that ring-shaped protrusion 51*b* may contact the inner surface of the tube 45. The sealing member 51 also may comprise a curved portion 51*c* facing the spherical member 52 and having a shape following the outer circumferential surface of the spherical member 52. The curved portion 51*c* may be surrounded by the ring-shaped protrusion 51*b*. The diameter of the opening 51*a* may be less than the outer diameter of a hollow tube 153 (described in more detail herein). When the hollow tube 153 is inserted into the opening 51*a*, the sealing member 51 may contact the outer surface of the hollow tube 153 while being elastically deformed. Therefore, ink leakage from between the sealing member 51 and the hollow tube 153 may be prevented.

The inner diameter of the ring-shaped protrusion 51*b* may be slightly less than the diameter of the spherical member 52. The fluid communication between the ink outlet path 43*a* and the outside of the ink cartridge 40 via the opening 51*a* may be prevented when the spherical member 52 contacts the ring-shaped protrusion 51*b*. The fluid communication between the ink outlet path 43*a* and the outside of the ink cartridge 40 via the opening 51*a* also may be prevented when the spherical member 52 contacts the curved portion 51*c*. In other words, the first valve 50 may be configured to prevent ink in the ink outlet path 43*a* from flowing via the first valve 50 when the spherical member 52 contacts the ring-shaped protrusion 51*b* and/or the curved portion 51*e*.

Referring to FIG. 7B, when the hollow tube 153 is inserted into the opening 51*a* via the ink discharge opening 46*a*, the tip of the hollow tube 153 may come into contact with the spherical member 52, and the spherical member 52 may move, thereby separating spherical member from the curved portion 51*c* and the ring-shaped protrusion 51*b*. When this occurs, the state of the first valve 50 may change from a closed state, in which the first valve 50 prevents ink in the ink outlet path 43*a* from flowing via the first valve 50, to an open state, in which the first valve 50 allows ink in the ink outlet path 43*a* to flow via the first valve 50.

The hollow tube 153 may have an opening 153*b* formed therethrough, and the inner space 153*a* of the hollow tube 153 may be in fluid communication with the outside of the hollow tube 153 via the opening 153*b*. When the first valve 50 is in the open state, the opening 153*b* of the hollow tube 153 has passed through the opening 51*a*. Thus, in the open state, the inner space 153*a* of the hollow tube 153 and the ink outlet path 43*a* may be in fluid communication via the opening 153*b*. When the hollow tube 153 is moved to be pulled out of the opening 51*a*, i.e., away from spherical member 52, the spherical member 52 may move toward the ring-shaped protrusion 51*b* due to the biasing force of the coil spring 53. When the spherical member 52 comes into contact with the ring-shaped protrusion 51*b*, the state of the first valve 50 changes from the open state to the closed state.

When the hollow tube 153 further moves out of the opening 51*a*, the spherical member 52 comes into close contact with the curved portion 51*c*. Accordingly, the first valve 50 is configured to selectively be in the open state and the closed state in accordance with insertion and removal of the hollow tube 153. Because the coil spring 53 is part of valve 50, and coil spring 53 biases the spherical member 52 toward the sealing member 51, and the structure of the first valve 50 is simplified and leakage of ink from the first valve 50 may be reduced or prevented.

Referring to FIGS. 7A and 7B, the second valve 60 may be disposed at the ink outlet path 43*a* between the ink bag 42 and the first valve 50. The second valve 60 may comprise a valve seat 61, a valve member 62, e.g., a second valve member, and a coil spring 63, e.g., a second biasing member, disposed in the ink outlet path 43*a*. The tube 44 may comprise a ring-shaped protrusion 44*a* protruding from the inner surface of the tube 44 into the ink outlet path 43*a* at a middle portion of the tube 44 in the first direction. The valve seat 61 may comprise an elastic material such as rubber or the like, and may comprise a flange 61*a* sandwiched between the ring-shaped protrusion 44*a* of the tube 44 and the platform portion 45*a* of the tube 45. The valve seat 61 may have an opening 61*b* formed therethrough, and the opening 61*b* may extend in the first direction at the middle of the valve seat 61, such that the interior of the tube 44 and the interior of the tube 45 may be in fluid communication with each other, and may form the ink outlet path 43*a*. The valve member 62 and the coil spring 63 each may be disposed in the ink outlet path 43*a* defined by the tube 44. Moreover, each of the diameter of the valve member 62 and the diameter of the coil spring 63 is less than the diameter of the ink outlet path 43*a* defined by the tube 44.

One end of the coil spring 63 may be in contact with the valve member 62 and the other end of the coil spring 63 may be in contact with the connecting portion 42*a*. The coil spring 63 is configured to constantly bias the valve member 62 toward the valve seat 61 and the sealing member 51, such that the portion of the valve seat 61 is elastically deformed by the biasing force of the coil spring 63. The valve member 62 may be configured to prevent ink in the ink outlet path 43*a* from flowing through the second valve 60 when the valve member 62 contacts a portion of the valve seat 61 surrounding the opening 61*b*. When this occurs, the valve member 62 is in a closed state, and fluid communication between the interior of the tube 44 and the interior of the tube 45 is prevented. Because the coil spring 63 is configured to bias the valve member 62 toward the sealing member 51, and because the first and second valves 50 and 60, i.e., the sealing member 51, the spherical member 52, the coil spring 53, the valve seat 61, the valve member 62, and the coil spring 63, are aligned on a single straight line in the first direction, the first and second valves 50 and 60 may be opened and closed when the hollow tube 153 is inserted into and pulled out of the sealing member 51 in the first direction. In an embodiment of the invention, the second valve 60 may have a simple structure, which may reduce a likelihood of opening or closing failure of the second valve 60. In an embodiment, the coil spring 63 is used as a biasing member, but in other embodiments, any a biasing member that biases the valve member 62 toward the valve seat 61 may be used.

The valve member 62 may have a substantially cylindrical shape, and may be configured to slide on the inner surface of the tube 44. A first end of the valve member 62 facing the connecting portion 42*a* may have a protruding shape that protrudes at the middle of valve member 62 in the first direction. The coil spring 63 may be fitted around the protruding portion of the valve member 62. A pressing member 70 may be disposed in the ink outlet tube 43. Pressing member 70 may be configured to press and move the valve member 62 in a direction opposite to a direction in which the coil spring 63 biases the valve member 62. The pressing member 70 may be a cylindrical rod extending in the first direction through the opening 61*b* of the valve seat 61. The pressing member 70 may be connected to a second end of the valve member 62 and, in an embodiment of the invention, may be integrally formed with the valve member 62. In an embodiment, the valve member 62 and pressing member 70 may constitute a movable member. The pressing member 70 may have a diameter less than the diameter of the opening 61*b*. The pressing member 70 may have such a length that a gap is formed between the tip of the pressing member 70 and the spherical member 52 when the state of the first valve 50 changes from the open state to the closed state, e.g., when the spherical member 52 moves toward the sealing member 51 to contact the ring-shaped protrusion 51*b*, while the second valve 60 is in the closed state, e.g., the valve member 62 contacts the valve seat 61.

Referring to FIG. 7B, after the hollow tube 153 is inserted through the sealing member 51 and the first valve 50 transitions into the open state, the spherical member 52 may come into contact with the tip of the pressing member 70. When the hollow tube 153 is further inserted, the pressing member 70 and valve member 62 may move, and the valve member 62 may moves away from the valve seat 61. Accordingly, the state of the second valve 60 transitions from the closed state to an open state. In the open state, the second valve 60 may allow ink in the ink outlet path 43*a* to flow via the second valve 60. When this occurs, the interior of the tube 44 and the interior of the tube 45 of the ink outlet path 43*a* may be brought into fluid communication, such that ink stored in the ink bag 42 may flow into the inner space 153*a* of the hollow tube 153.

Similarly, when the hollow tube 153 is removed from the sealing member 51, the valve member 62 and pressing member 70 may move, due to the biasing of the coil spring 63 toward the valve seat 61, and the valve member 62 may contact the valve seat 61. Accordingly, the state of the second valve 60 may transition from the open state to the closed state. Thus, the second valve 60 also may be configured to selectively be in the open state, in which the second valve 60 allows ink in the ink outlet path 43*a* to flow via the second valve 60, and the closed state, in which the second valve 60 prevents ink in the ink outlet path 43*a* from flowing via the second valve 60.

The photo-sensor 66, which may be electrically connected to the contact 91, may be disposed in the chamber 41*b* of the housing 41. In another embodiment of the invention, photo-sensor 66 may be disposed in the ink outlet path 43*a*. In yet another embodiment, photo-sensor 66 may be integrally formed with tube 45, or another portion of the cartridge along the ink outlet path 43*a*. The photo-sensor 66 may be a reflection-detecting type optical sensor configured to detect the presence or absence of an object at a predetermined position without contacting the object. In an embodiment of the invention, the photo-sensor 66 may be substantially aligned with at least a portion of valve seat 61. The photo-sensor 66 is disposed facing the second end portion of the valve member 62 in the second direction when the second valve 60 is in the closed state, as shown in FIG. 7A, and so as not to face the second end portion of the valve member 62 in the second direction when the second valve 60 is in an open state, as shown in FIG. 7B. In an embodiment of the invention, the valve member 62 moves from the closed state to the open state in the first cartridge direction. Thus, a distance between the valve member 62 and the photo-sensor 66 in the second cartridge direction when the valve member 62 is in the closed state is the same as a distance between the valve member 62 and the photo-sensor 66 in the second cartridge direction when the valve member is in the open state.

The photo-sensor 66 may comprise a light-emitting portion and a light-receiving portion, and a mirror face capable of reflecting light is formed at least on the second end portion of the valve member 62. When the photo-sensor 66 faces the valve member 62, the light emitted from the light-emitting portion may be reflected at the mirror face of the valve member 62, and the reflected light may be received at the light-receiving portion. Thereupon, the photo-sensor 66 may output a signal indicating that the light-receiving portion is receiving light. This signal will hereinafter be interchangeably referred to as "detection signal A." Referring to FIG. 8, detection signal A may be transmitted to the controller 100 of the main unit of the ink jet printer 1 via contacts 91 and 161.

Referring again to FIG. 7, on the other hand, when the photo-sensor 66 does not face the valve member 62, the light emitted from the light-emitting portion may not be reflected at the mirror face of the valve member 62, such that light may not be received at the Light-receiving portion. Thereupon, the photo-sensor 66 may output a signal indicating that the light-receiving portion is not receiving light. This signal will hereinafter be interchangeably referred to as "detection signal B." Detection signal B may be transmitted to the controller 100 of the main unit of the ink jet printer 1 via contacts 91 and 161. In an embodiment of the invention, the strength of the signal transmitted by the photo-sensor 66 may be determined by an intensity of light that reaches the photo-sensor 66. Thus, in an embodiment of the invention, detection signal A, which corresponds to the photo-sensor 66 receiving light, may have a greater signal strength, e.g., have a higher voltage, than detection signal B, which corresponds to the photo-sensor 66 not receiving light, e.g., which may be a lower voltage signal than detection signal A. The controller 100 may be configured to determine whether the second valve is in the open state or closed state based on the signals the controller 100 receives. In this embodiment, upon receiving the detection signal A indicating that the light-receiving portion is receiving light, the controller 100 may determine that the second valve 60 is in the closed state, and upon receiving the detection signal B indicating that the light-receiving portion is not receiving light, the controller 100 may determine that the second valve 60 is in the open state. In an embodiment of the invention, when the further valve 60 is in a closed state, valve member 62 may be substantially aligned with a center of photo-sensor 66, and when the further valve 60 is in an open state, valve member 62 may not be aligned with the center of photo-sensor 66.

The photo-sensor 66 is not restricted to a reflection-detecting type sensor, and in another embodiment, the photo-sensor 66 may be a light-transmission-detecting type optical sensor comprising a light-emitting portion and a light-receiving portion facing each other, and the photo-sensor 66 may detect whether an object is absent or present between the light-emitting portion and the light-receiving portion.

Figure 9A:
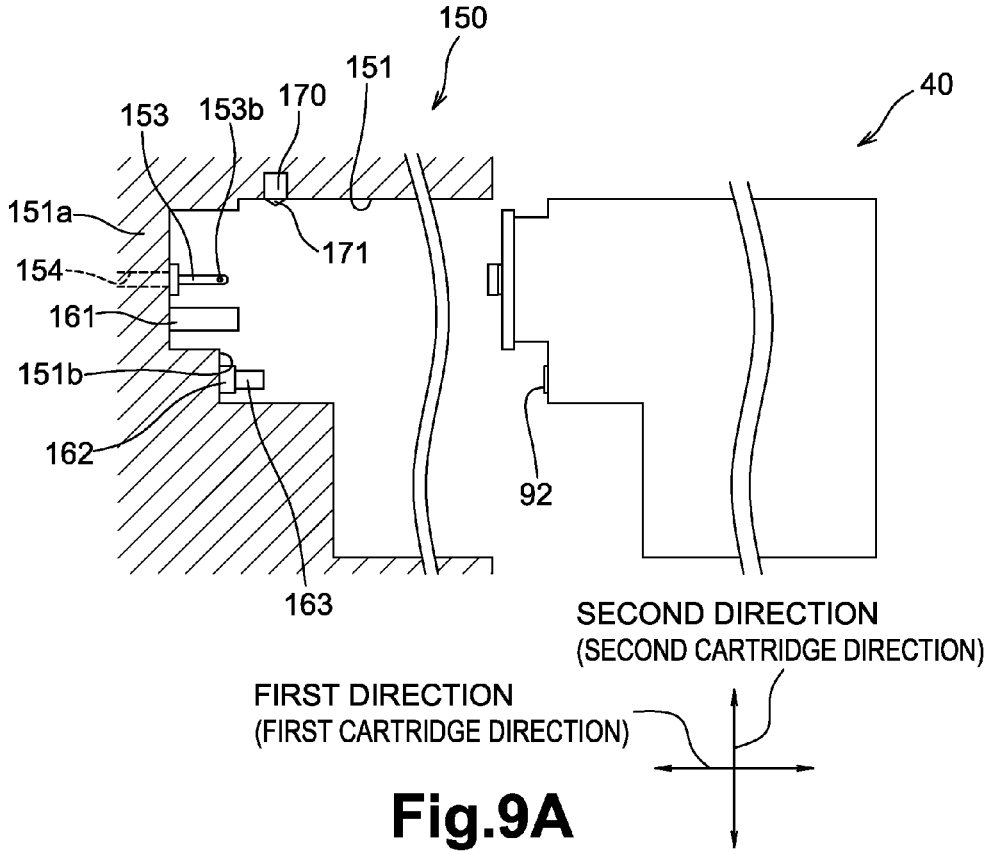
FIG. 9A is a partial horizontal cross-sectional view of a mounting portion and top views of the ink cartridge of FIG. 5, in which the ink cartridge is not yet mounted in the mounting portion, according to an embodiment of the invention.
Figure 9B:
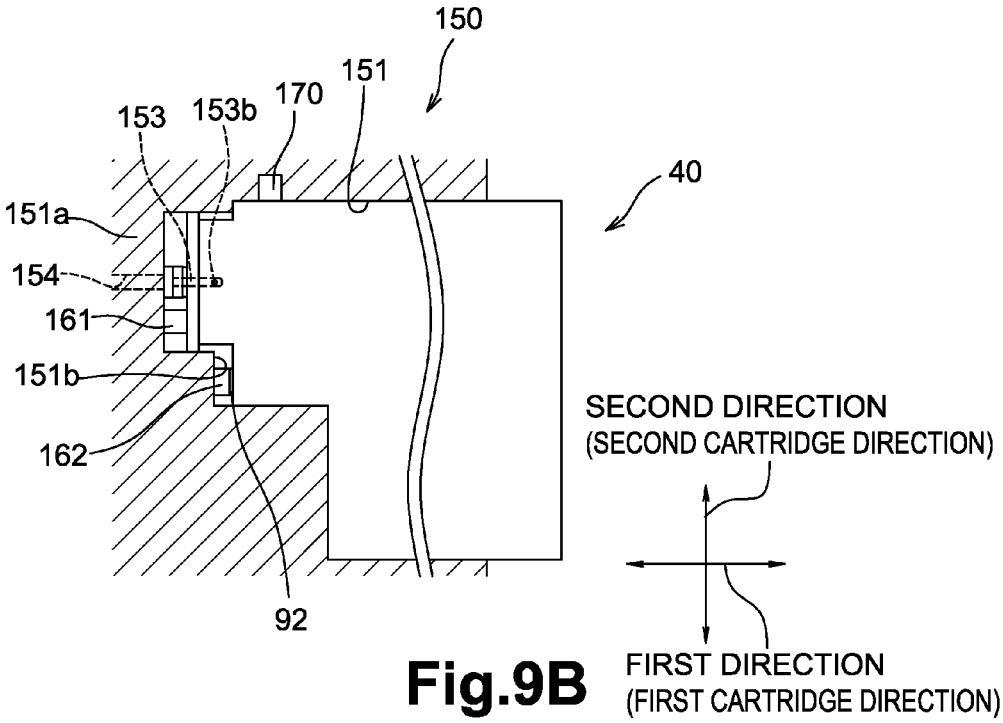
FIG. 9B is a partial horizontal cross-sectional view of a mounting portion and top views of the ink cartridge of FIG. 5, in which the ink cartridge is completely mounted in the mounting portion, according to an embodiment of the invention.

Referring to FIGS. 8 to 9B, the main unit of the ink jet printer 1 may comprise a plurality of, e.g., four, mounting portions 150 arrayed in the second direction, to which the ink cartridges 40 may be mounted, respectively. Each of the four mounting cartridges 150 has substantially the same structure. Accordingly, only one mounting portion 150 is described herein. Referring to FIGS. 9A and 9B, the mounting portion 150 may have a recess 151 formed therein. The recess 151 may have a shape corresponding to the outer shape of the ink cartridge 40. The hollow tube 153 may be disposed at a base portion 151*a* defining an end of the recess 151 in the second direction. The ink supply path 154 may be formed in the base portion 151*a* and may be in fluid communication with the inner path of the flexible tube connected to the ink jet head 2.

Referring to FIGS. 9A and 9B, the mounting portion 150 has a recess 151 formed therein having a shape corresponding to the outer shape of the ink cartridge 40. The hollow tube 153A may be disposed at a base portion 151*a* defining an end of the recess 151 in the second direction. The ink supply path 154 may be formed in the base portion 151*a* and may be in fluid communication with the inner path of the flexible tube connected to the ink jet head 2. The contact 161 may be electrically connected to the controller 100, and the electric power output portion 162 for outputting electric power from an electric power source 110, e.g., as shown in FIG. 8, of the main unit of the ink jet printer 1, also may be disposed at the base portion 551*a*.

The hollow tube 153 may extend in the first direction, and may be disposed at a position corresponding to the opening 51*a* when the ink cartridge 40 is mounted to the mounting portion 150. The hollow tube 153 has the inner space 153*a* formed therein, which may be in fluid communication with the ink supply path 154, and also has the opening 153*b* formed therethrough near the tip thereof to allow the inner space 153*a* to be in fluid communication with the outside of the hollow tube 53, as shown in FIGS. 7A and 7B.

When the ink cartridge 40 is mounted to mounting portion 150 and the hollow tube 153 is inserted into the sealing member 51, such that the opening 153*b* enters the ink outlet path 43*a* defined by the tube 45 past the opening 51*a*, the inner space 153*a* of the hollow tube 153 and the ink outlet path 43*a* may be placed into fluid communication via the opening 153*b*. Similarly, when the ink cartridge 40 is removed from the mounting portion 150 and the hollow tube 153 is removed from the sealing member 51, such that the opening 153*b* enters the opening 51*a*, the path between the inner space 153*a* of the hollow tube 153 and the ink outlet path 43*a* is blocked, and there is no fluid communication between inner space 153*a* and ink outlet path 43*a*. Even if the inner space 153*a* of the hollow tube 153 is in fluid communication with the ink outlet path 43*a* via the opening 153*b*, either by first valve 50 being in the open state, or by a malfunction of first valve 50, ink stored in ink bag 42 may not flow into the inner space 153*a* until the second valve 60 transitions to the open state.

The path extending from the opening 153*b* of the hollow tube 153 to the discharge nozzles of the ink jet head 2 may be substantially a sealed path not open to the atmosphere. Thus, the likelihood that ink may into contact with air is reduced, and an increase in the viscosity of the ink may be reduced or eliminated.

The contact 161 may be aligned with the hollow tube 153 in the second direction, and may be disposed at a position corresponding to the contact 91 of the ink cartridge 40 when the ink cartridge 40 is mounted to the mounting portion 150. The contact 161 may be a rod-shaped member extending in the first direction, and may be slidably supported. The contact 161 may be biased from the base portion 151*a* outwards by a spring (not shown) in the first direction, so as to be electrically connected to the contact 91 immediately before the hollow tube 153 is inserted into the sealing member 51 when the ink cartridge 40 is mounted to the mounting portion 150. In other words, the contact 161 may be electrically connected to the contact 91 before the first valve 50 transitions to the open state. Stated differently, the contact 161 may be electrically connected to the contact 91 until the hollow tube 153 is removed from the sealing member 51 completely when the ink cartridge 40 is removed from the mounting portion 150.

The electric power output portion 162 may be provided at a shoulder surface 151*b* formed on the base portion 151*a*. The electric power output portion 162 may be disposed on the shoulder surface 151*b* at a position corresponding to the electric power input portion 92, and may comprise a contact 163 protruding in the first direction. The contact 163 may be inserted into the recess of the electric power input portion 92, and thereby electrically connected to the electric power input portion 92 when the ink cartridge 40 is mounted to the mounting portion 150. The contact 163 may be electrically connected to the electric power input portion 92 immediately before the hollow tube 153 is inserted into the sealing member 51.

A sensor 170, which may be connected to the controller 100, may be disposed in the recess 150, for detecting the presence and absence of the housing 41 in the mounting portion 150. The sensor 170 may be a mechanical switch configured to detect whether or not an object is present by contacting the object. Sensor 170 may comprise a detecting portion 171 disposed in recess 151 from a housing of the sensor 170, and biased outward from recess 151.

When the detecting portion 171 comes into contact with the housing 41 and the detecting portion 171 enters into the housing of the sensor 170 against a biasing force, the sensor 170 outputs a signal indicating that the detecting portion 171 has entered into the housing of the sensor 170. This signal is hereinafter interchangeably referred to as "detection signal C" to the controller 100. When the ink cartridge 40 is removed from the mounting portion 150 and the detecting portion 171 and the housing 41 are no longer in contact, the detecting portion 171 may comes out of the housing of the sensor 170 and the sensor 170 may output a signal indicating that the detecting portion 171 has come out of the housing of the sensor 170. This signal is hereinafter interchangeably referred to as "detection signal D" to the controller 100.

The controller 100 may be configured to determine whether the ink cartridge 40 is mounted to the mounting portion 150 based on the signals received by controller 100. In an embodiment, upon receiving the detection signal C indicating that the detecting portion 171 has entered the housing of the sensor 170, the controller 100 determines that the ink cartridge 40 is mounted to the mounting portion 150 or the ink cartridge 40 is almost completely mounted to the mounting portion 150, and upon receiving the detection signal D indicating that the detecting portion 171 having come out of the housing of the sensor 170, the controller 100 determines that the ink cartridge 40 is not mounted to the mounting portion 150. The sensor 170 is not restricted to a mechanical switch. In another embodiment, the sensor 170 may be an optical sensor.

Referring to FIGS. 2 and 8, a signal generator, e.g., a buzzer 13, may be provided in the housing 1*a*. The buzzer 13 may be controlled by the controller 100, and may be configured to emit multiple types of sounds whereby the user can be notified that, for example, "the ink cartridge 40 is not mounted correctly," "ready to print," and the like. When the ink cartridge 40 is intended to be mounted to the mounting portion 150, the door 1*c* is opened, and the ink cartridges 40 may be mounted to the mounting portion 150.

Figure 10:
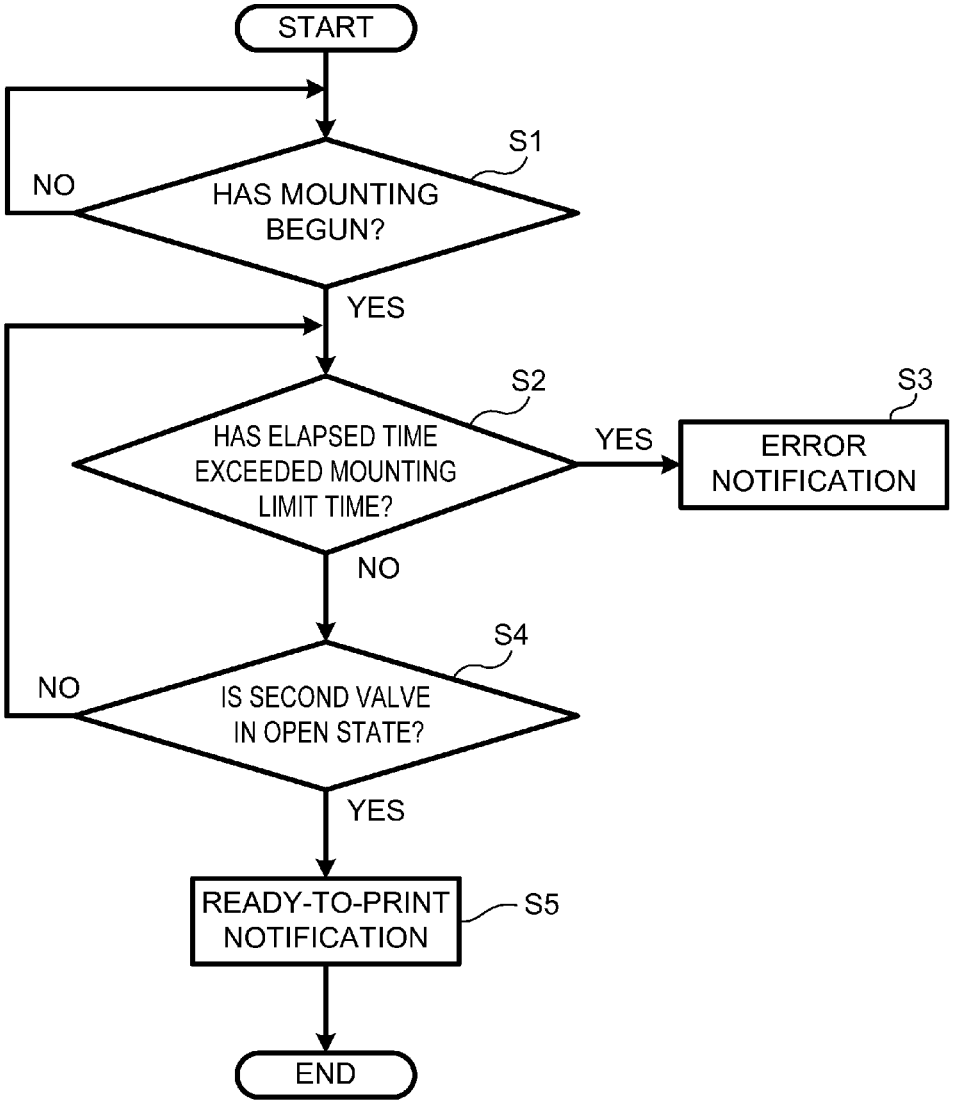
FIG. 10 is a flowchart of control during a mounting of the ink cartridge to the mounting portion, according to an embodiment of the invention.

Referring to FIG. 10, at Step S1, the controller 100 may determines whether mounting of the ink cartridges 40 to the mounting portions 150 has begun. This determination may be based on whether the controller 100 receives the detection signal C. As described above, the signal output from the sensor 170 may change from the detection signal D to the detection signal C, when the detecting portion 171 of the sensor 170 comes into contact with the housing 41.

When the controller 100 does not receive the detection signal C from the sensor 170 but rather receives the detection signal D, the controller 100 determines that the mounting has not begun yet and stands by, e.g., "NO" at Step S1, and repeats Step S1. When the controller 100 receives the detection signal C from the sensor 170, e.g., "YES" at Step S1, then the controller 100 may determine that the mounting has begun, and the processing may proceed to Step S2.

In Step S2, the controller 100 may determine whether a mounting limit time has elapsed from the time when the controller 100 initially received the detection signal C, i.e., since the controller 100 determined that the mounting has begun at Step S1. The controller 100 may determine whether this time has, elapsed before the time the controller 100 initially receives the detection signal B from the photo-sensor 66. This determination may be based on whether the time elapsed since the controller 100 initially receives the detection signal C at S1 has exceeded the mounting limit time. Referring to FIG. 8, the value of the mounting limit time may be stored in a storing portion 120 of the main unit of the ink jet printer 1. Referring again to FIG. 10, if at Step S2, it is determined that the elapsed time has exceeded the mounting limit time, e.g., "YES" at Step S2, the flow advances to step 3. In Step S3, the controller 100 then controls the buzzer 13 to send a notification. The notification corresponds to a message that "the ink cartridge is not mounted correctly to the mounting portion," e.g., with a sound from the buzzer 13.

On the other hand, if at Step S2, the elapsed time has not exceeded the mounting limit time, when the controller 100 initially receives the detection signal B from the photo-sensor 66, e.g., "NO" at Step S2, then processing may continue to Step S4. For example, if the tip of the hollow tube 153 is broken off, if the pressing member 70 is fractured, or the mounting of the ink cartridge 40 is stopped before the second valve becomes the open state, the valve member 62 may not move. In such a case, processing may flow to Step S3, which may indicate that an error has occurred.

In Step S4, the controller 100 may determine whether the second valve 60 is in the open state. This determination may be based on whether the controller 100 receives the detection signal B. As described above, when the valve member 62 moves, such that the photo-sensor 66 and the valve member 62 no longer face each other, the detection signal A which has been output from the photo-sensor 66 changes to the detection signal B. If the controller 100 receives the detection signal A and determines that the second valve 60 is in the closed state, e.g., "NO" at Step S4, then processing returns to Step S2, and if the controller 100 receives the detection signal B and determines that the second valve 60 is in the open state, e.g., "YES" at Step S4, then processing advances to Step S5.

From the time when the detection signal C starts to be output from the sensor 170 until the second valve 60 becomes the open state, the followings occur. First, during the period of time after the detection signal C starts to be output from the sensor 170 to the controller 100, and before the hollow tube 153 starts to be inserted to the opening 51*a*, the contact 91 and the contact 161 are electrically connected, and the contact 163 of the electric power output portion 162 and the electric power input portion 92 may be electrically connected. Accordingly, the photo-sensor 66 and the controller 100 may be electrically connected, such that the controller 100 may receive signals output from the photo-sensor 66, and electric power may be supplied to the photo-sensor 66.

Subsequently, as the hollow tube 153 is inserted into the opening 51*a*, the tip of the hollow tube 153 may contact with the spherical member 52 and the spherical member 52 may move toward the second valve 60, e.g., to the right, when aligned as shown in FIGS. 7A and 7B, such that the spherical member 52 may be separated from the curved portion 51*c* and the ring-shaped protrusion 51*b*, and the state of the first valve 50 may transition from the closed state to the open state. Subsequently, the spherical member 52 may contact with the tip of the pressing member 70 and the pressing member 70, spherical member 52, and valve member 62 may move toward the connecting portion 42*a*, e.g., to the right when aligned as shown in FIGS. 7A and 7B). The valve member 62 and the valve seat 61 may be separated from each other, and the state of the second valve 60 may transition from the closed state to the open state. Thus, when the second valve 60 transitions to the open state, the contact 91 and the contact 161 may be in electrical contact, such that the controller 100 may receive the detection signal B output from the photo-sensor 66.

The determination of whether or not the second valve 60 is in the open state in Step S4 thus also may include a determination of whether the hollow tube 153 has been correctly inserted into the ink cartridge 40. In other words, by the photo-sensor 66 detecting whether the valve member 62 is at a predetermined position, e.g., a position where the valve member 62 is a predetermined distance away from the valve seat 61, the controller 100 may determine whether or not the hollow tube 153 has been correctly inserted into the ink outlet path 43*a*, Therefore, an ink path may be correctly formed from the ink cartridge 40 to the main unit of the ink jet printer 1, e.g., to the mounting portion 150.

In step S5, the controller 100 may control the buzzer 13 to emit a sound from the buzzer 13, indicating "ready to print." Thus, the mounting of the ink cartridge 40 may be completed.

Referring to FIGS. 7A and 7B, the ink cartridge 40 may be removed from the mounting portion 150, e.g., because all the usable ink from ink cartridge 40 has been dispensed. The spherical member 52, the valve member 62, and the pressing member 70 may move together in a direction away from the connecting portion 42*a*, e.g., to the left when disposed as shown in FIGS. 7A and 713, while contacting each other, due to the biasing forces of the coil springs 53 and 63, in accordance with the movement of the hollow tube 153 being removed from the ink outlet tube 43 as the ink cartridge 40 is removed from the mounting portion 150. In other words, when hollow tube 153 is removed, the spherical member 52, the pressing member 70, and the valve member 62 move in a direction opposite to a direction in which they move when the hollow tube 153 is inserted into the sealing member 51. When the valve member 62 comes into contact with the valve seat 61, and the state of the second valve 60 transitions from the open state to the closed state. When this occurs, the flow of ink from the ink bag 42 to the inner space 153*a* of the hollow tube 153 stops. At this time, the signal output from the photo-sensor 66 to the controller 100 may change from the detection signal B to the detection signal A, and the controller 100 may determine that the second valve 60 is in the closed state.

Subsequently, only the spherical member 52 moves along with the hollow tube 153, such that the spherical member 52 and the tip of the pressing member 70 may be separated. The spherical member 52 then may contact with the ring-shaped protrusion 51*b* and curved portion 51*c*, so the state of the first valve 50 transitions from the open state to the closed state. Thus, the state of each of the first and second valves 50 and 60 may change from the open state to the closed state in accordance with the movement of the hollow tube 153 removed of the sealing member 51. The first valve 50 may transition to the closed state after the second valve 60 transitions to the closed state.

After the ink cartridge 40 moves further and the hollow tube 153 is completely removed from the sealing member 51, the contact between the contact 91 and contact 161, and the contact between the electric power input portion 92 and contact 163, may be cut off. When the housing 41 is separated from the detecting portion 171 and the detecting portion 171 comes out of the sensor 170, the detection signal D may be output from the sensor 170 to the controller 100. Accordingly, the controller 100 may determine that the ink cartridge 40 has been removed from the mounting portion. In this way, the old ink cartridge 40 is removed from the mounting portion 105, and a new ink cartridge 40 may be mounted to the mounting portion 105.

A method for manufacturing and refurbishing the ink cartridge 40 according to an embodiment of the invention, will be described. When the ink cartridge 40 is manufactured, the housing 41 first may be fabricated as two parts, and parts such as the ink bag 42 and ink outlet tube 43 are assembled in the first half of the housing 41, as shown in FIG. 6. The second half of the housing 41 then may be attached to the first half of the housing 41. Next, a predetermined amount of ink may be injected into the ink bag 42 via the ink outlet path 43*a*. Thus, manufacturing of the ink cartridge 40 is completed. In another embodiment of the invention, parts of the ink cartridge 40 other than the housing 41 may be assembled, into which ink may be injected. Then, the assembled parts may be attached into the housing 40. In yet another embodiment of the invention, a used ink cartridge 40 may be refurbished. When a used ink cartridge 40 is refurbished, first, the ink bag 42, ink outlet tube 43, and so forth may be washed. Next, a predetermined amount of ink may be injected into the ink bag 42. Thus, refurbishing of ink cartridge 40 is completed.

As described above, according to the above embodiments, when the ink cartridge 40 is mounted to the mounting portion 150, the spherical member 52 and the movable member, e.g., pressing member 70 and valve member 62, may move due to insertion of the hollow tube 153. Thus, the state of the valve member 62, e.g., open or closed, may be determined by the detection of the photo-sensor 66, and also whether the hollow tube 153 has been correctly inserted into the ink cartridges 40 may be determined. In other words, by the photo-sensor 66 detecting whether the movable member is in the predetermined position, it can be determined whether the hollow tube 153 has been properly inserted into the ink outlet path 43*a*. Accordingly, that the ink path extending from the ink cartridge 40 to the main unit of the ink jet printer 1, e.g., to the mounting portion 150, may be detected as correctly formed.

As an example, in an embodiment of the invention, if the tip of the hollow tube 153 is broken off, the hollow tube 153 cannot move the valve member 62 when the ink cartridge 40 is mounted to the mounting portion 150, and therefore ink may not be supplied to the ink jet head 2 when printing is performed. In such a case, printing failure may occur. Nevertheless, in such a case, it is determined at Step S2 that the hollow tube 153 has not been properly inserted into the ink outlet path 43*a*, and the error is notified at Step S3. Hence, the printing failure may be avoided.

As another example, in an embodiment of the invention, when a user stops the mounting of the ink cartridge 40 after the hollow tube 153 is inserted into the sealing member 51 and before the hollow tube 153 starts to move the valve member 62, ink cannot be supplied to the ink jet head 2 when printing is performed. In such a case, printing failure may occur. Nevertheless, in such a case, it may be determined that the hollow tube 153 has not been properly inserted into the ink outlet path 43*a*, and the error is notified at Step S3. Hence, the printing failure can be avoided.

As yet another example, in an embodiment of the invention, when a user stops the mounting of the ink cartridge 40 after the valve member 62 starts to move but before the valve member 62 moves to a position sufficiently away from the valve seat 61, printing failure may occur because the gap between the valve member 62 and the valve seat 61 is too small and sufficient flow rate of ink may not be obtained when printing is performed. Nevertheless, in such a case, it may be determined that the hollow tube 153 has not been properly inserted into the ink outlet path 43*a* at Step S2, and the error is notified at Step S3. Hence, the printing failure may be avoided.

The coil spring 63 may bias the valve member 62 toward the sealing member 51. This may enable accurate positioning of the valve member 62, which moves by being pressed by the hollow tube 153, whereby the precision of the detection by the photo-sensor 66 may be increased.

In an embodiment of the invention, the movable member may function as the valve member 62. Thus, the determination of whether the ink path has been correctly formed from the ink cartridge 40 to the main body of the ink jet printer 1, e.g., to the mounting portion, and the opening/closing of the second valve 60 may be simultaneously determined. Therefore, the complexity of the controller 100, and the overall costs of manufacturing the ink jet printer 1 may be reduced. Moreover, the first valve 50 may allow sealing of the ink within the ink cartridge 40 to be performed more securely.

In another embodiment of the invention, the pressing member 70 may not be not integrally formed with the valve member 62, but may be integral with the spherical member 52. In yet another embodiment, the pressing member 70 may be integral with neither the spherical member 52 nor the valve member 62, and may be positioned between the spherical member 52 and the valve member 62. The same advantages as in the above embodiment may be obtained by these modified embodiments as well. Further, in the still another embodiment, the photo-sensor 66 may detect the spherical member 52 instead of the valve member 62. Determination of whether or not the hollow tube 153 has been correctly inserted may be made by this arrangement as well.

Figure 15A:
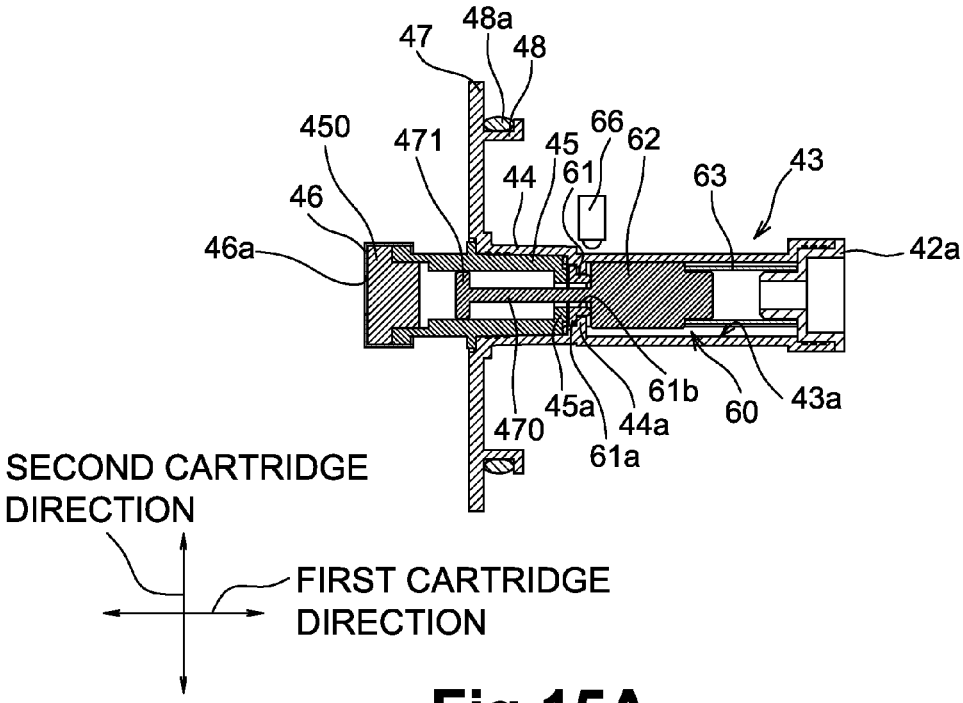
FIG. 15A is a partial horizontal cross-sectional view of the ink cartridge in which each of a first valve and a second valve is in a closed state, according to still yet another embodiment of the invention.
Figure 15B:
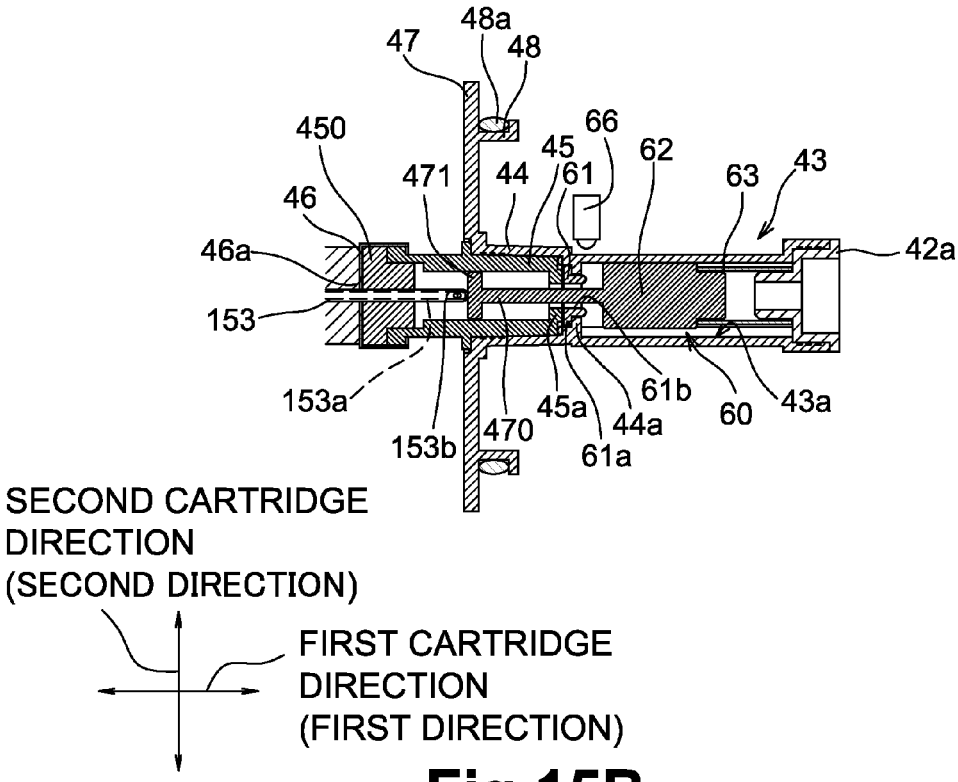
FIG. 15B is a partial horizontal cross-sectional view of the ink cartridge in which each of the first valve and the second valve is in an open state, according to still yet another embodiment of the invention.

FIGS. 15A and 15B describe still yet another embodiment of the invention, in which the first valve 50 may comprise a sealing member 450, which may be an elastic member positioned in the ink outlet path 43*a*. Sealing member 450 may contact the inner surface of the tube 45 to close the opening of the ink outlet path 43*a* formed at the second end of the ink outlet path 43*a*, and the first valve 50 does not comprise a spherical member and a coil spring. An opening is not formed through the sealing member 450. In this modified embodiment, the number of parts may be reduced. In this embodiment, a pressing member 470 may comprises a wide-diameter portion 471 extending from the outer surface of the tip of the pressing member 470. The wide-diameter portion 471 may have a diameter slightly less than the inner diameter of the tube 45. Accordingly, referring to FIG. 15B, the pressing member 470 and the tip of the hollow tube 153 may come into contact in a stable manlier. The seating member 450 may comprise the same material as the sealing member 51 in the previously described embodiments.

In this embodiment, when the hollow tube 153 is inserted into the sealing member 450 for the first time, the sealing member 450, which may be acting as the first valve, may transition to the open state when the hollow tube 153 passes through the sealing member 450. Specifically, when the tip of the hollow tube 153 goes beyond the right end of the sealing member 450, sealing member 450 may be penetrated therethrough, thereby elastically deforming sealing member 450, i.e., compressing sealing member 450 to allow hollow tube 153 to pass therethrough, without removing any portion of sealing member 450. As shown in FIGS. 15A and 15B, the elastic deformation of sealing member 450 may transition the particular valve to the open state. However, once the hollow tube 153 has been removed from the sealing member 450 at least once, then when the hollow tube 153 is inserted into the sealing member 450 again, the sealing member 450 as the first valve becomes the open state when the tip of the hollow tube 153 is inserted into the sealing member 450, i.e., when the tip of the hollow tube 153 goes beyond the left end of the sealing member 450 in FIGS. 15A and 15B. More specifically, an opening may be formed through the sealing member 450 when the hollow tube 153 is inserted through the sealing member 450 for the first time, whereby the sealing member 450 transitions to the open state. When the hollow tube 153 is removed from the sealing member 450, the opening formed through the sealing member 450 may be closed off by the elastic force of the sealing member 450, by the sealing member 450 elastically reforming to seal the hole created by the penetration of hollow tube 153, thereby transitioning the particular valve to the closed state. When the hollow tube 153 is inserted into the sealing member 450 again, the opening of the sealing member 450 which has previously been closed, is opened by the insertion of the tip of the hollow tube 153 therein, and thereby the sealing member 450 may transition to the open state.

Referring to FIG. 15A, because a gap is formed between the sealing member 450 and the tip of the pressing member 470 in the first direction when the hollow tube 153 is not inserted into the sealing member 450, the second valve 60 may transition to the open state after the sealing member 450 as the first valve transitions to the open state. When the hollow tube 153 is removed from the sealing member 450 from a state in which the hollow tube 153 is in the ink outlet path 43*a* and the valves 450 and 60 are in the open state, the second valve 60 transitions to the closed state first, and then the sealing member 450 transitions to the closed state when the hollow tube 153 is pulled out of the sealing member 450 completely.

In this embodiment, the gap may be, formed between the sealing member 450 and the tip of the pressing member 470 when the hollow tube 153 is not inserted into the sealing member 450. Nevertheless, in another embodiment, there may be no gap between the sealing member 450 and the tip of the pressing member 470 when the hollow tube 153 is not inserted into the sealing member 450. In other words, the sealing member 450 and the tip of the pressing member 470 may maintain contact when the hollow tube 153 is not inserted into the sealing member 450. In this case, when the hollow tube 153 comes into contact with the pressing member 470, the sealing member 450 as the first valve is already in the open state, and further insertion of the hollow tube 153 from this state causes the second valve 60 to transition to the open state. When the hollow tube 153 is removed from the sealing member 450, the sealing member 450 transitions to the closed state after the second valve 60 transitions to the closed state. Accordingly, the same advantages as in the first embodiment may be obtained as well.

Also, in yet still another embodiment, the ink cartridge 40 may not include the second valve 60, but may comprise a movable member which moves in accordance with the insertion of the hollow tube 153 in the ink outlet path 43*a*, instead of the second valve 60. In this embodiment, in Step S4, the determination by the controller 100 does not correspond to the determination of whether or not the second valve 60 is in the open state, but corresponds to the determination of whether or not the hollow tube 153 has been correctly inserted into the ink cartridge 40. Also, the movable member may be configured to be biased by a biasing member in a direction opposite to the insertion direction of the hollow tube 153, while the movement of the movable member is restricted to within a predetermined range. The photo-sensor 66 may be configured to detect the position of this movable member. Because the second valve 60 is eliminated from this embodiment, the reliability of the first valve 50 may be increased to reduce ink leakage.

In this embodiment, for example, if the hollow tube 153 is broken off from its base portion, the hollow tube 153 may not be able to be inserted into the first valve 50 when the ink cartridge 40 is mounted to the mounting portion 150, and therefore the first valve 50 may not transition to the open state. When this occurs, ink may not be supplied to the ink jet head 2 when printing is performed, and printing failure may occur. Nevertheless, in such a case, it is determined that the hollow tube 153 has not been properly inserted into the ink outlet path 43*a*, and the error may be notified at Step S3.

In still yet another embodiment, if the tip of the hollow tube 153 is broken off, the broken tip of the hollow tube 153 may damage the sealing member 51 when the ink cartridge 40 is mounted to the mounting portion 150. In such a case, ink may leak from the damaged sealing member 51. Nevertheless, in such a case, it is determined that the hollow tube 153 has not been properly inserted into the ink outlet path 43*a*, and the error may be notified at Step S3. Accordingly, a user may notice that the hollow tube 153 is broken, and therefore ink leakage due to the broken hollow tube 153 may be avoided before ink leakage occurs.

Also, in yet still another embodiment, a magnetic sensor is used instead of the photo sensor 66. In this embodiment, the second valve member 62 comprises a magnet, and the magnetic sensor comprises a hall element. When the second valve member 62 faces the sensor, the magnetic flux density at the hall element is high, and the sensor outputs the detection signal A. When the second valve member 62 does not face the sensor, the magnetic flux density at the hall element is low, and the sensor outputs the detection signal B.

Figure 11:
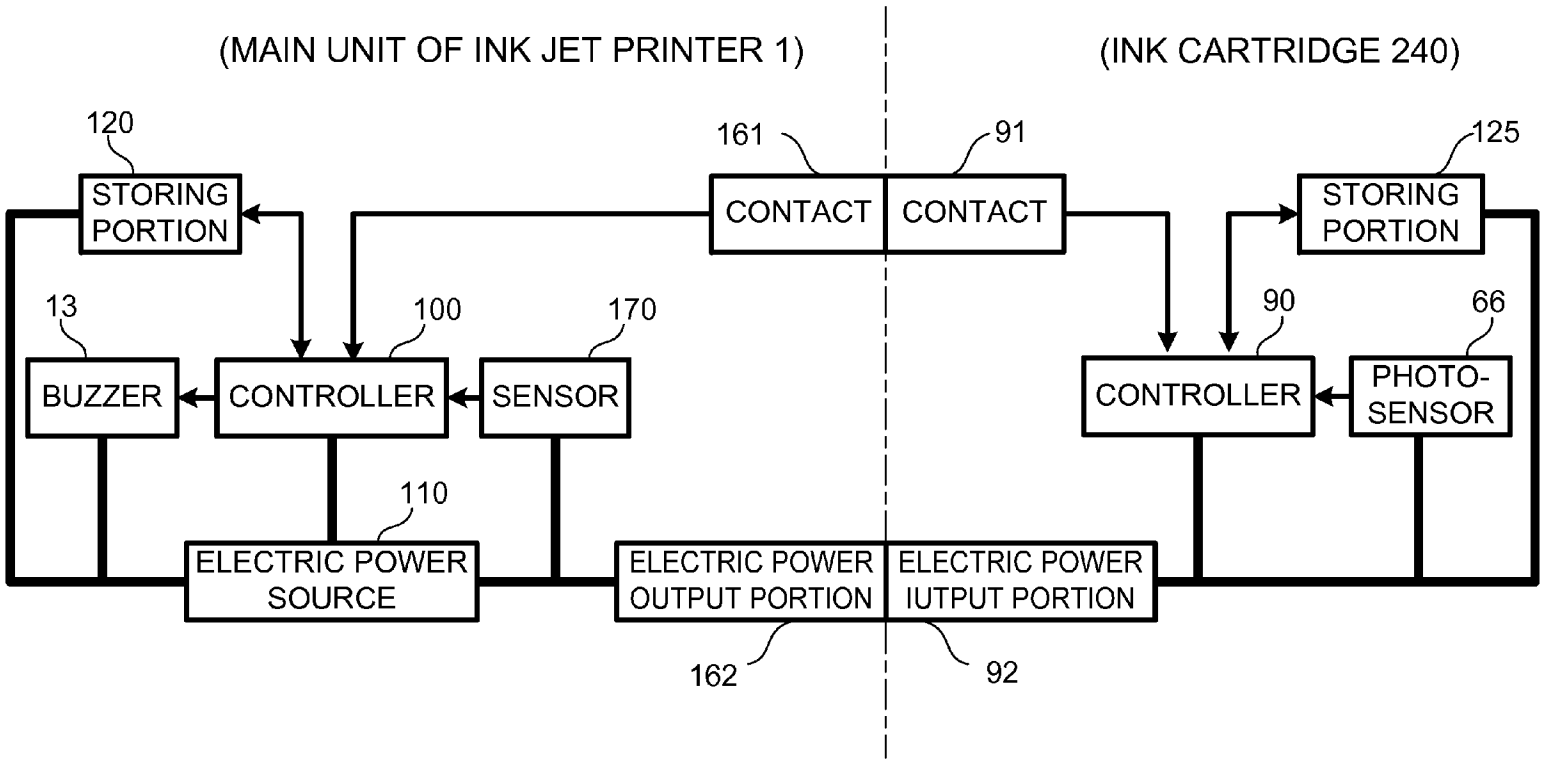
FIG. 11 is a block diagram of the electrical configuration of an ink jet printer, according to another embodiment of the invention.
Figure 12:
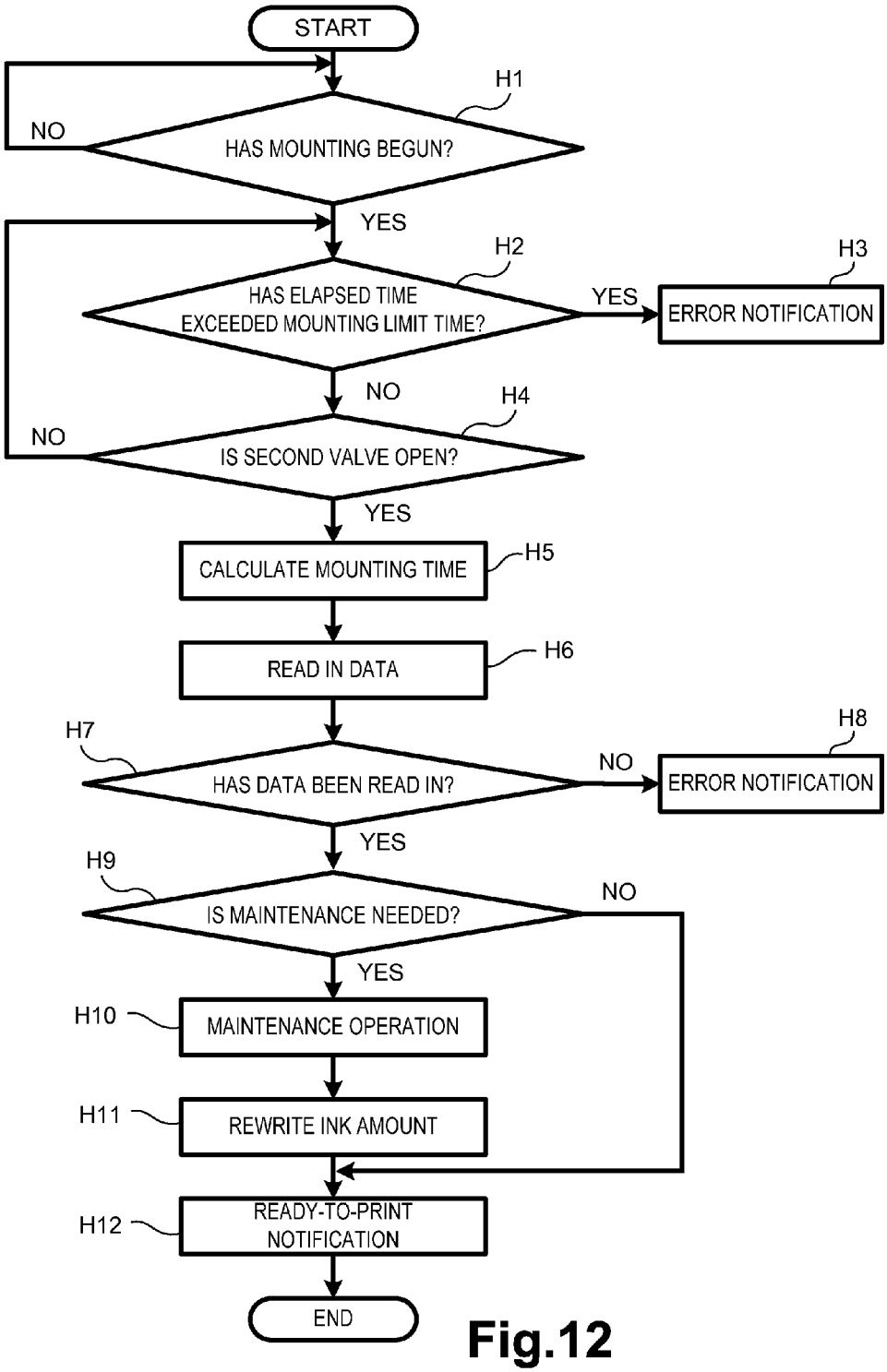
FIG. 12 is a flowchart of control during a mounting the ink cartridge to a mounting portion, according to another embodiment of the invention.

FIGS. 11 and 12 describe an ink cartridge 240 according to a further embodiment of the invention. Ink cartridge 240 may comprise a controller 90, and a storing portion 125 connected to the controller 90, in addition to the components of the ink cartridge 40 of the first embodiment. Components which are the same as or equivalent to those in the first embodiment will be denoted with the same reference numerals and description thereof will be omitted.

Referring to FIG. 11, the controller 90 provided to the ink cartridge 240 may be electrically connected to the contact 91. Also, the controller 90 may be electrically connected to the electric power input portion 92. When the electric power input portion 92 is electrically connected to the electric power output portion 162, electric power may be supplied to the controller 90 and the photo-sensor 66. The photo-sensor 66 according to this further embodiment may not be directly connected to the contact 91, and may be connected to the controller 90. Accordingly, the photo-sensor 66 may the detection signal A and detection signal B to the controller 90. The controller 90 then may transmit the detection signal A and detection signal B received from the photo-sensor 66 to the controller 100 of the ink jet printer 1 via the contacts 91 and 161.

Incidentally, when the ink cartridge 240 is mounted to the mounting portion 150, ink may leak from the discharge nozzles of the corresponding ink jet head 2. When the mounting of the ink cartridge 240 to the mounting portion 150 is completed and the ink cartridge 240 stops moving, ink may still move in the ink bag 42 due to the inertia built up in the ink by the movement of the ink cartridge 240. This movement of ink in the ink bag 42 may cause pressure fluctuation in the ink, and such pressure fluctuation may be transferred to ink in the ink jet head 2, which may push ink out of the discharge nozzles. The amount of ink leakage from the discharge nozzles depends on the speed at which the ink cartridge 240 is mounted to the mounting portion 150 and the amount of ink stored in the ink cartridge 240.

The storing portion 125 may store the data shown in the Table 1 below. Table 1 shows whether or not there is need to perform a maintenance by the maintenance unit 30 for the ink jet heads 2 when the ink cartridge 240 is mounted to the mounting portion 150, and the amount of ink leakage from the discharge nozzles of the ink jet heads 2. Specifically, whether there is need to perform the maintenance, and the amount of ink leakage, are shown corresponding to three time ranges T1 to T3 and four ink amount ranges V1 to V4. As for an example of the time ranges T1 to T3, the time range T1 is a range from 0 second to less than 0.5 seconds (0 sec.≤T1<0.5 sec.), the time range T2 is a range from 0.5 seconds to less than 1.5 seconds (0.5 sec.≤T2<1.5 sec.), and the time range T3 is a range from 1.5 seconds to less than 2.5 seconds (1.5 sec.≤T3<2.5 sec.), with the ranges being adjacent to each other. Also, as for an example of ink amount ranges V1 to V4, the ink amount range V1 is a range from 0 milliliter to less than 500 milliliters (0 ml≤V1<500 ml), the ink amount range V2 is a range from 500 milliliters to less than 700 milliliters (500 ml≤V2<700 ml), the ink amount range V3 is a range from 700 milliliters to less than 800 milliliters (700 ml≤V3<800 ml), and the ink amount range V4 is a range from 800 milliliters to less than 1000 milliliters (800 ml≤V4<1000 ml), with the ranges being adjacent to each other.

TABLE 1

| Time | Ink amount range | | | |
|---|---|---|---|---|
| Range | V1 | V2 | V3 | V4 |
| T1 | Maintenance unnecessary No ink leakage | Maintenance necessary Ink leakage about 0 ml | Maintenance necessary Ink leakage minute | Maintenance necessary Ink leakage small |
| T2 | Maintenance unnecessary No ink leakage | Maintenance unnecessary No ink leakage | Maintenance necessary Ink leakage about 0 ml | Maintenance necessary Ink leakage minute |
| T3 | Maintenance unnecessary No ink leakage | Maintenance unnecessary No ink leakage | Maintenance unnecessary No ink leakage | Maintenance necessary Ink leakage about 0 ml |

The mounting time may be a period of time from the time when the mounting of the ink cartridge 240 to the mounting portion 150 is started to the time when the state of the second valve 60 transitions from the closed state to the open state. The description herein is merely exemplary to illustrate operation of one embodiment of the invention. Other embodiments may use different values for the data stored in storing portion 125. The storing portion 125 may store data indicating that there is no ink leakage and the maintenance is unnecessary, if the ink amount stored in the ink cartridge 240 mounted in the mounting portion 150 falls within the range of V1, and if a mounting time falls within either one of the time ranges T1 to T3.

Moreover, the storing portion 125 stores data indicating that there is ink leakage of about 0 ml and the maintenance is necessary, if the ink amount stored in the ink cartridge 240 mounted in the mounting portion 150 falls within the range of V2, and if the mounting time falls within the time range T1. The storing portion 125 stores data indicating that there is no ink leakage and the maintenance is unnecessary, if the ink amount stored in the ink cartridge 240 mounted in the mounting portion 150 falls within the range of V2, and if the mounting time falls within either one of the time ranges T2 and T3. In other words, the storing portion 125 stores data indicating that when the mounting time is below 0.5 seconds (predetermined time) there may be slight ink leakage (although it may be 0 ml), and that the maintenance is necessary.

Also, the storing portion 125 stores data indicating that there is minute ink leakage (e.g., around 1 ml) and the maintenance is necessary, if the ink amount stored in the ink cartridge 240 mounted in the mounting portion 150 falls within the range of V3, and if the mounting time falls within the time range T1. The storing portion 125 stores data indicating that there is ink leakage of about 0 ml and the maintenance is necessary, if the ink amount stored in the ink cartridge 240 mounted in the mounting portion 150 falls within the range of V3, and if the mounting time falls within the time range T2. The storing portion 125 stores data indicating that there is no ink leakage and the maintenance is unnecessary, if the ink amount stored in the ink cartridge 240 mounted in the mounting portion 150 falls within the range of V3, and if the mounting time falls within the time range T3. In other words, when the amount of ink stored in the ink cartridge 240 falls within the range of V3, the maintenance is necessary if the mounting time is below 1.5 seconds (predetermined time), and the maintenance is unnecessary if the time range is greater than or equal to 1.5 seconds.

Also, the storing portion 125 stores data indicating that there is a small amount of ink leakage, e.g., around 3 ml, and the maintenance is necessary, if the ink amount stored in the ink cartridge 240 mounted in the mounting portion 150 falls within the range of V4, and if the mounting time falls within the time range T1. The storing portion 125 stores data indicating that there is minute ink leakage and the maintenance is necessary, if the ink amount stored in the ink cartridge 240 mounted in the mounting portion 150 falls within the range of V4, and if the mounting time falls within the time range T2. The storing portion 125 stores data indicating that there is ink leakage of about 0 ml and the maintenance is necessary, if the ink amount stored in the ink cartridge 240 mounted in the mounting portion 150 falls within the range of V4, and if the mounting time falls within the time range T3. Further, the storing portion 125 stores data indicating that there is no ink leakage and maintenance is unnecessary, if the mounting time is greater than or equal to 2.5 seconds, e.g., a predetermined time, and if the ink amount stored in the ink cartridge 240 mounted in the mounting portion 150 is less than 1000 ml.

Thus, the storing portion 125 stores data indicating the predetermined time (0 seconds, 0.5 seconds, 1.5 seconds; or 2.5 seconds) serving as a boundary, e.g., a threshold, indicating whether or not there is necessity to perform the maintenance, for each of the ink amount ranges V1 to V4. In other words, for the ink amount range V1, the predetermined time of 0 seconds is stored, for ink amount range V2 the predetermined time of 0.5 seconds is stored, for ink amount range V3 the predetermined time of 1.5 seconds is stored, and for ink amount range V4 the predetermined time of 2.5 seconds is stored. If these predetermined times are longer, then the ink amounts indicated by ink amount ranges V1 to V4 may be greater.

Also, the storing portion 125 may comprise a flash memory which may be rewritten by the controller 90 or an external device, e.g., the controller; and also may store data indicating the ink amount stored in the ink cartridge 240. Accordingly, an ink amount obtained by subtracting the ink amount consumed by printing and the ink amount consumed by purging from the ink amount of the ink cartridge 240 stored immediately prior to rewriting, can be rewritten in the storing portion 125 by the controller 100. Further, the storing portion 125 also stores the ink leakage amounts, so the ink amount may be corrected at the time of rewriting the ink amount. In other words, the controller 90 may rewrite the ink amount from which the ink leakage amount at the time of mounting the ink cartridge 240 to the mounting portion 150 has also been subtracted. Accordingly, the storing portion 125 may accurately store the current amount of ink stored in the ink cartridge 240.

When a used ink cartridge 240 is refurbished, the amount of ink injected into the ink cartridge 240 may be more or less than the amount of ink stored in the ink cartridge 240 when the ink cartridge 240 is originally manufactured. In such a case, the data indicating the injected amount of ink may be rewritten. Also, because the storing portion 125 is provided to the ink cartridge 240, the storage capacity of the storing portion 120 of the main unit of the ink jet printer 1 may be reduced.

Referring to FIG. 12, when the ink cartridge 240 is intended to be mounted to the mounting portion 150, Steps H1 to H3 may be performed in the same may as the Steps S1 to S4 of the above-described embodiment. In Step 114, the controller 100 may determine whether the second valve 60 is in the open state. This determination is made based on whether the controller 100 receives the detection signal B. As described previously, when the valve member 62 moves, such that the photo-sensor 66 and the valve member 62 no longer face each other, the detection signal A which has been output from the photo-sensor 66, may change to the detection signal B.

If the controller 100 receives the detection signal A and determines that the second valve 60 is in the closed state, e.g. "NO" at Step H4, processing may return to Step H2, and if the controller 100 receives the detection signal B and determines that the second valve 60 is in the open state, e.g., "YES" at Step H4, then processing may advance to Step 115. Similarly to the previously-described embodiments, the determination of whether the second valve 60 is in the open state in step H4 also may include the determination of whether the hollow tube 153 has been correctly inserted into the ink cartridge 240.

From the time when the detection signal C starts to be output from the sensor 170 until the second valve 60 transitions to the open state, the following steps may occur. First, during the period of time after the detection signal C starts to be output from the sensor 170 to the controller 100 and before the hollow tube 153 starts to be inserted to the opening 51*a*, the contact 91 and the contact 161 may be electrically connected, and the contact 163 of the electric power output portion 162 and the electric power input portion 92 may be electrically connected. Accordingly, the two controllers 90 and 100 may be electrically connected, such that the two controllers 90 and 100 may exchange signals with each other.

Moreover, electric power is supplied to the controller 90 and the photo-sensor 66. When the contact 91 and the contact 161 are connected, tune data signal indicating the time at which the controller 100 determines the start of mounting, e.g., the time at which the controller 100 initially receives the detection signal C from the sensor 170, may be output from the controller 100 to the controller 90. Subsequently, as the hollow tube 153 is inserted into the opening 51*a*, the tip of the hollow tube 153 may contact with the spherical member 52 and the spherical member 52 moves toward the second valve 60, e.g., to the right when aligned as shown in FIGS. 7A and 7B), such that the spherical member 52 may be separated from the curved portion 51*c* and ring-shaped protrusion 51*b*, and the state of the first valve 50 may transition from the closed state to the open state.

Subsequently, the spherical member 52 may contact with the tip of the pressing member 70, and the spherical member 52, the pressing member 70, and the valve member 62 may move toward the connecting portion 42*a*, e.g., to the right when aligned as shown in FIGS. 7A and 7B. The valve member 62 and the valve seat 61 then may be separated from each other, and the state of the second valve 60 may transition from the closed state to the open state. Thus, when the second valve 60 transitions to the open state, the contact 91 and the contact 161 may be electrically connected, and the controller 100 may receive the detection signal B output from the controller 90.

Next, in Step H5, the controller 90 may calculate the mounting time between the time when the mounting of the ink cartridge 240 to the mounting portion 150 was stored, e.g., the time at which the controller 100 initially received the detection signal C from the sensor 170, which may be derived from the time date transmitted from the controller 100 to the controller 90, and the time when the controller 90 initially received the detection signal B from the photo-sensor 66. In Step H6, the controller 90 may read in the data indicating the current amount of ink stored in the ink cartridge 240 and the data shown in the Table 1, stored in the storing portion 125. Next, in Step H7, the controller 90 may determine whether the data in the storing portion 125 has been read in Step H6. If there is no data stored in the storing portion 125 and accordingly no data can be read in, e.g., "NO" at Step H7, then an error signal is output from the controller 90 to the controller 100, and processing may advance to Step H8. In Step H8, the controller 100, which has received the error signal, may control the buzzer 13 to notify the user that there is an abnormality in the storing portion 125.

If it is determined in Step H7 that the controller 90 successfully read in the data of the storing portion 125, e.g., "YES" at Step H7, then processing may advance to Step H9. In Step H9, the controller 90 may determine which of the time ranges T1 to T3 the mounting time calculated in Step H5 falls within, and also may determine which of the ink amount ranges V1 to V4 the amount of ink read in Step H7 falls within. Based on this information, controller 90 may determine whether to perform the maintenance for the ink cartridge 240. In other words, determination is made regarding whether or not the mounting time (one of T1 to T3) is below the predetermined time indicating the boundary, e.g., threshold of whether the maintenance is required, with regard to the ink amount range (one of V1 to V4) corresponding to the amount of ink stored in the ink cartridge 240.

If the controller 90 determines not to perform the maintenance, e.g., "NO" at Step H9, the processing advances to Step 1112. If the controller 90 determines to perform maintenance, e.g., "YES" at Step H9, then processing advances to Step H10, and the controller 90 may output a signal to the controller 100 requesting starting of the maintenance. Referring to FIG. 4A, the controller 100 first may control the elevator mechanism, such that the ink jet heads 2 may move from the printing position to the retracted position. Next, referring to FIG. 4B, the controller 100 may control the driving motor to move the caps 31 to positions facing the discharging faces 2*a*. The controller 100 then may control the driving motor to position the caps 31 at capping positions near the discharging faces 2*a*.

Then, the controller 100 may drive the pumps for a predetermined period of time, and forcibly may feed ink from the ink cartridges 240 to the ink jet heads 2. Accordingly, a predetermined amount of ink may be purged from the ink jet heads 2 within the caps 31. Subsequently, the controller 100 controls the driving motor to return the caps 31 from the purging position to the initial position. At this time, the controller 100 may control a wiping mechanism (not shown), e.g., a wiper (not shown) and a driving motor (not shown) for driving the wiper included in the maintenance unit 30, so as to wipe ink adhering to the discharging faces 2*a* due to the purging operation. The controller 100 then may control the elevator mechanism to return the ink jet heads 2 from the retracted position to the printing position, thereby ending the maintenance procedure. When the maintenance ends, the controller 100 may output a signal notifying the controller 90 of ending of the maintenance.

Next, in Step H11, the controller 90 may rewrite the date of the amount of ink stored in the storing portion 125. Specifically, a first determination is made regarding whether the amount of ink leakage is approximately 0 ml, the minute amount, or the small amount. Next, the ink amount of ink stored in the storing portion 125 may be rewritten with a value obtained by subtracting the amount of ink leakage that has been determined and the amount of ink consumed in purging operations from the currently stored amount of ink.

The amount of ink consumed in the purging operation is not restricted to a certain predetermined amount, and may be adjusted as appropriate taking into consideration environmental conditions such as temperature and the like, and in such a case, the controller 100 may notify the controller 90 of the amount of ink consumed in the purging operation. Thereafter, the processing may continue to Step H13 [It appears Step H12 has been eliminated]. Next, in Step H13, the controller 90 may output a signal to the controller 100 indicating that printing can be performed. The controller 100 which has received this signal then may control the buzzer 13 to emit a sound from the buzzer 13 to notify the user of "ready to print." Thus, mounting of the ink cartridge 240 is completed.

In another embodiment, rewriting of the amount of ink in Step H11 may be performed before the printing is performed. In the ink jet printer 1 according to this embodiment, in addition to the above-described Steps H10 and H11, the controller 100 or controller 90 may be configured to rewrite the amount of ink by subtracting the amount of ink consumed in one printing operation after the ink cartridge 240 has been mounted to the mounting portion 150 from the amount of ink immediately before that operation was performed. Accordingly, even if an ink cartridge 240 with a certain amount of ink remaining therein is removed from the mounting portion 150 and mounted again to the mounting portion 150, the maintenance may be performed on the ink jet head 2 only in cases in which the mounting time (falling within one of T1 to T3) calculated by the controller 90 is below the predetermined time corresponding to the remaining amount of ink (falling within one of V1 to V4). Accordingly, unnecessary maintenance can be avoided.

When ink stored in the ink cartridge 40 is depleted, the door 1*c* of the ink jet printer 1 is opened and the ink cartridge 240 is removed from the mounting portion 150, in the same way as in the previous embodiments described above. As the ink cartridge 240 is moved to be removed, the spherical member 52, valve member 62, and pressing member 70 move toward the sealing member 51, e.g., to the left when aligned as in FIGS. 7A and 7B, while contacting each other, due to the biasing forces of the coils springs 53 and 63. When the valve member 62 comes into contact with the valve seat 61, the state of the second valve 60 may transition from the open state to the closed state, and the flow of ink from the ink bag 42 to the inner space 153*a* of the hollow tube 153 may stops. At this time, the signal output from the photo-sensor 66 to the controller 90 may change from the detection signal B to the detection signal A, and the controller 90 may determine that the second valve 60 is in the closed state.

Subsequently, only the spherical member 52 may move along with the hollow tube 153, such that the spherical member 52 and the tip of the pressing member 70 may be separated. The spherical member 52 then may come into contact with the ring-shaped protrusion 51*b* and curved portion 51*c*, such that the state of the first valve 50 may transition from the open state to the closed state. Thus, the state of each of the first and second values 50 and 60 may transition from the open state to the closed state in accordance with the movement of the hollow tube 153 pulled out of the sealing member 51. The first valve 50 transitions to the closed state after the second valve 60 transitions to the closed state.

After the ink cartridge 240 moves further and the hollow tube 153 is completely removed from the sealing member 51, the contact between the contact 91 and contact 161, and the contact between the electric power input portion 92 and contact 163, may be cut off. When the housing 41 is separated from the detecting portion 171 and the detecting portion 171 comes out of the sensor 170, the detection signal D may be output from the sensor 170 to the controller 100. Accordingly, the controller 100 may determine that the ink cartridge 240 has been removed from the mounting portion 150. In this way, the old ink cartridge 240 is removed from the mounting portion 105, and a new ink cartridge 240 may be mounted to the mounting portion 105.

A method for manufacturing and refurbishing the ink cartridge 240 according to an embodiment of the invention, will be described. When the ink cartridge 240 is manufactured, the housing 41 first may be fabricated in two pieces, and parts such as the ink bag 42 and ink outlet tube 43 are assembled in the first half of the housing 41. The second half of the housing 41 is then attached the first half of the housing 41, similarly to the above-described embodiments. Next, a predetermined amount of ink is injected into the ink bag 42 via the ink outlet path 43*a*, similarly to the above-described embodiments. Further, the data shown in Table 1 and data indicating the ink amount that has been injected may be stored in the storing portion 125 of the ink cartridge 240. Thus, manufacturing of the ink cartridge 240 is completed.

In another embodiment of the invention, parts of the ink cartridge 240 other than the housing 41 may be assembled, to which ink is injected. And then, the assembled parts are attached into the housing 240. Subsequently, the predetermined data may be stored in the storing portion 125.

When a used ink cartridge 40 is refurbished, first, the ink bag 42, ink outlet tube 43, and so forth may be washed. Next, a predetermined amount of ink may be injected into the ink bag 42. Then, the data of the amount of ink stored in the storing portion 125 of the ink cartridge 240 is replaced with the data indicating the amount of ink that has been injected. Thus, refurbishing of ink cartridge 40 is completed. As described above, according to this embodiment, when the ink cartridge 240 is mounted to the mounting portion 150, the spherical member 52 and the movable member, e.g., pressing member 70 and valve member 62, may move due to insertion of the hollow tube 153, and whether or not the valve member 62 is in the open state can be determined by the detection of the photo-sensor 66, and also whether or not the hollow tube 153 has been correctly inserted into the ink cartridges 240 may be determined.

Also, in the ink jet printer 1 according to this embodiment, when the ink cartridge 240 is mounted to the mounting portion 150, the controller 90 may calculate the mounting time. When the position of the ink cartridge 240 at which the sensor 170 initially detects the ink cartridge 240 is defined as a first position, and the position of the ink cartridge 240 at which the second valve 60 transitions to the open state, the distance between the first position and the second position in the mounting direction may be substantially constant. The first position also may be defined as the position of the ink cartridge 240 at which the signal output from the sensor 170 changes from the detection signal D to the detection signal C from the detecting portion 171 by the contact between the detection portion 171 of the sensor 170 and the housing 41.

The second position further may be defined as the position of the ink cartridge 240 at which the signal output from the photo-sensor 66 changes from the detection signal A to the detection signal B when the photo-sensor 66 moves relative to the valve member 62 from a state facing the valve member 62 to a state not facing the valve member 62. Therefore, by calculating the time that the ink cartridge 240 requires to move between the first position and the second position as the mounting time, how fast the ink cartridge 240 was mounted to the mounting portion 150 can be known. When the ink cartridge 240 is mounted at a slow speed, the mounting time is long, and the pressure fluctuation generated in ink at the time of mounting is short. On the other hand, when the ink cartridge 240 is mounted at a fast speed, the mounting time is short, and the pressure fluctuation at the time of mounting may be relatively great. The controller 90 determines whether the calculated mounting time is below the predetermined time based on the data shown in Table 1. Accordingly, when the ink cartridge 240 is mounted to the mounting portion 150 at high speed, the maintenance of the ink jet heads 2 may be performed, thereby preventing faulty discharge from occurring at the ink jet head 2.

Also, the storing portion 125 may store the predetermined time serving as the boundary, e.g., threshold, of whether the maintenance is necessary for each ink amount range V1 to V4. The maintenance may be performed on the ink jet heads 2 in cases in which the mounting time which the controller 90 has calculated is below the predetermined time corresponding to the relevant ink amount range V1 to V4. Accordingly, unnecessary maintenance can be avoided. Also, as the predetermined times serving as the boundaries, e.g., thresholds, are defined to be longer, the greater the amount of ink indicated by the ink amount range V1 to V4 may be. Accordingly, whether or not the maintenance of the ink jet heads 2 is necessary may be determined with high precision, and faulty discharge at the ink jet heads 2 may be prevented.

Also, in the ink cartridge 240 according to this embodiment, the maintenance unit 30 and the controller 100 controlling the maintenance unit 30 may be provided to the main unit of the ink jet head 1, such that if the mounting time is below the predetermined time stored in the storing portion 125, the maintenance of the ink jet head 2 may be performed. Accordingly, faulty discharge at the ink jet head 2 may be prevented.

In still another embodiment, the sensor 170 may be provided at such a position that the sensor 170 may detect the housing 41 at the time when the state of the first valve 50 transitions from the closed state to the open state. In this case, the detection signal C output from the sensor 170 to the controller 100 may indicate that the first valve 50 is in the open state, and the detection signal D output from the sensor 170 to the controller 100 may indicate that the first valve 50 is in the closed state. Also, in this embodiment, for example, the ring-shaped protrusion 51*b* may be longer in the first direction, such that when the ink cartridge 240 is mounted to the mounting portion 150, the first valve 50 may transition to the open state after the second valve 60 transitions to the open state. Thus, the mounting time may be a period of time between the time when the state of the first valve 50 transitions from the closed state to the open state and the time when the state of the second valve 60 transitions from the closed state to the open state.

Figure 13:
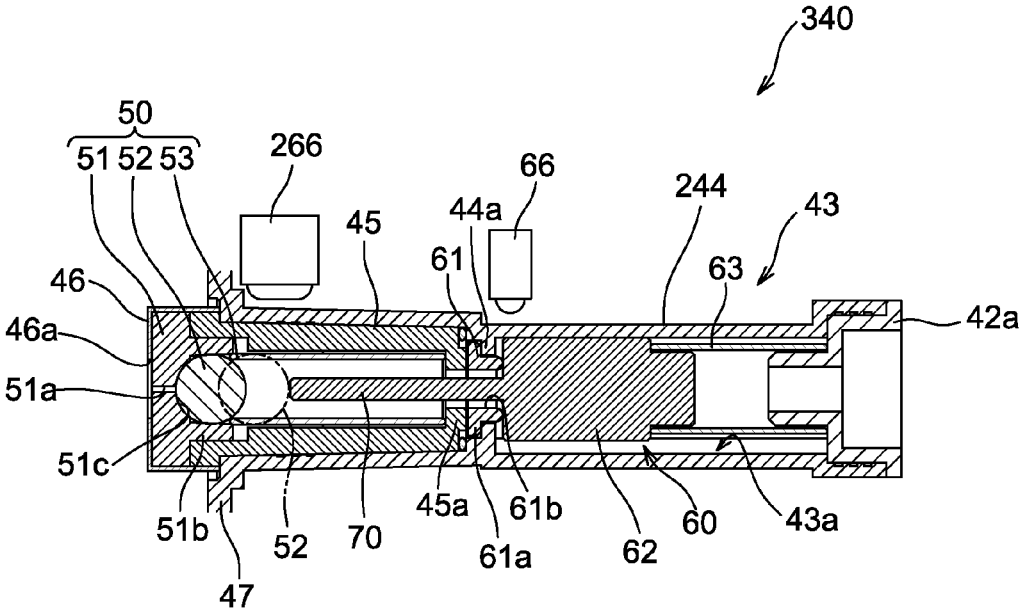
FIG. 13 is a partial horizontal cross-sectional view of an ink cartridge, according to yet another embodiment of the invention.
Figure 13:
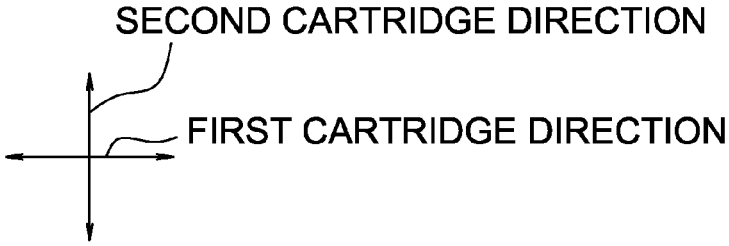

FIG. 13 illustrates an ink cartridge 340 according to a still yet another embodiment of the invention. Ink cartridge 340 may comprise a tube 244 instead of the tube 44. The difference between the tube 244 and the tube 44 is that the portion of tube 244 into which the tube 45 is fitted is longer than that of tube 44 in the first direction. Accordingly, compared to the previously described embodiments, more of the tube 45 is positioned in the tube 44, such that the ink discharge opening 46*a* may be positioned closer to the flange 47, e.g., as shown in FIG. 13, compared to FIGS. 7A and 7B. A photo-sensor 266 may be configured to detect the presence or absence of an object is disposed in the housing 41 adjacent the first valve 50. A reflection-detecting type optical sensor comprising a light-emitting portion and light-receiving portion can be used for the photo-sensor 266 for example. A mirror face capable of reflecting light may be formed at least on a portion of the spherical member 52. Other configurations are the same as in the first and second embodiments, and accordingly will be denoted with the same reference numerals and specific description thereof will be omitted.

The photo-sensor 266 may be connected to the controller 90 and the electric power input portion 92. Referring to FIG. 13, the photo-sensor 266 may be disposed so as not to face the spherical member 52 when the ring-shaped protrusion 51*b* and the spherical member 52 are in contact, and to face the spherical member 52 when the ring-shaped protrusion 51*b* and the spherical member 52 are separated, as shown in FIG. 13 as a double-dot dashed line. When the photo-sensor 266 faces the spherical member 52, the photo-sensor 266 may output a signal indicating that the light-receiving portion is receiving light. This signal is hereinafter interchangeably referred to as "detection signal E." Similarly, when the photo-sensor 266 does not face the spherical member 52, the photo-sensor 266 may output a signal indicating that the light-receiving portion is not receiving light. This signal is hereinafter interchangeably referred to as "detection signal F."

These signals may be transmitted to the controller 100 of the main unit of the ink jet printer 1 via the controller 90. The controller 100 may receive these signals, and accordingly may determine whether first valve 50 is in the open state or the closed state. In this embodiment, when the controller 100 receives the detection signal E indicating that the light-receiving portion is receiving light, the controller 100 may determine that the first valve 50 is in the open state, and when the controller 100 receives the detection signal F indicating that the light-receiving portion is not receiving light, the controller 100 may determine that the first valve 50 is in the closed state.

When the ink cartridge 340 is mounted to the mounting portion 150, first, Step H1 to Step H4 may be performed in the same way as in the previously described embodiments. The contact 91 and the contact 161, and the contact 163 of the electric power output portion 162 and the electric power input portion 92 may be electrically connected, before the first valve 50 transitions to the open state, such that the two controllers 90 and 100 may be electrically connected and capable of exchanging signals with each other. Moreover, electric power may be supplied to the controller 90 and the photo-sensors 66 and 266.

In an alternate embodiment, in Step H2, the controller 100 may determine whether the mounting limit time has expired, because the controller 100 initially may receive the detection signal E from the photo-sensor 266 by the time the controller 100 initially receives the detection signal B from the photo-sensor 66. In the case of this modified embodiment, the mounting limit time stored in the storing portion 120 is different from the mounting limit time of the previously described embodiments. Further, in this embodiment, the mounting limit time may be stored in the storing portion 125, and the controller 90 may perform the processing in Step H2. Moreover, the controller 90 may determine whether the second valve 60 is in the open state in Step H4. In this case, the detection signal 13, which may indicate the open state of the second valve 60, may optionally not be outputted from the controller 90 to the controller 100.

Referring again to FIG. 13, in Step H5, the controller 90 may calculate the mounting time between the time when the controller 90 initially received the detection signal E from the photo-sensor 266 and the time when the controller 90 initially received the detection signal B from the photo-sensor 66. Subsequently, Step H6 to Step H13 are performed in the same way as in the previous embodiment. Because the time for calculating the mounting time is changed from the time at which the controller 100 initially receives the detection signal C from the sensor 170 in the previous embodiment to the time when the controller 90 initially received the detection signal E from the photo-sensor 266, e.g., the time at which the state of the first valve 50 transitions from the closed state to the open state, so the data shown in Table 1 may be different from the data of the previous embodiments.

When ink stored in the ink cartridge 340 is depleted, the door 1*c* of the ink jet printer 1 may be opened, and the ink cartridge 240 may be removed from the mounting portion 150, in the same way as in the previous embodiments described above. As the ink cartridge 340 is moved to be removed, the spherical member 52, the valve member 62, and the pressing member 70 may move toward the sealing member 51, e.g., to the left in FIG. 13, while contacting each other, due to the biasing forces of the coil springs 53 and 63. In other words, the spherical member 52, the pressing member 70, and valve member 62 move in a direction opposite to a direction in which the hollow tube 153 is inserted into the ink outlet path 43*a*.

When the valve member 62 conies into contact with the valve seat 61, the state of the second valve 60 may transition from the open state to the closed state, and the signal output from the photo-sensor 66 to the controller 90 may change from the detection signal B to the detection signal A, and the controller 90 may determine that the second valve 60 is in the closed state. Subsequently, when the spherical member 52 comes into contact with the ring-shaped protrusion 51*b*, e.g., when the state of the first valve 50 changes from the open state to the closed state, the signal output from the photo-sensor 266 to the controller 90 may change from the detection signal E to the detection signal F, and the controller 90 may determine that the first valve 50 is in the closed state.

After the ink cartridge 340 moves further and the hollow tube 153 is completely removed from the sealing member 51, the contact between the contact 91 and contact 161, and the contact between the electric power input portion 92 and contact 163, may be cut off. When the housing 41 is separated from the detecting portion 171 and the detecting portion 171 comes out of the sensor 170, the detection signal D is output from the sensor 170 to the controller 100. Accordingly, the controller 100 may determine that the ink cartridge 340 has been removed from the mounting portion 150. In this way, the old ink cartridge 340 is removed form the mounting portion 105, and a new ink cartridge 340 is mounted to the mounting portion 105.

As described above, similarly to the previous embodiments, according to this embodiment, when the ink cartridge 340 is mounted to a mounting portion 150, whether the hollow tube 153 has been correctly inserted into the ink cartridges 340 can be determined.

In this embodiment, when the ink cartridge 340 is mounted to the mounting portion 150, the controller 90 may calculate the mounting time and may determine whether there is need to perform the maintenance. The photo-sensor 266 for detecting the absence and the presence of the first valve 50 at a predetermined position is provided, and the controller 90 may calculate the mounting time between the time at which the detection signal B indicating that the second vale 60 is in the open state is initially output from the photo-sensor 66 and the at which the detection signal E indicating that the first valve 50 is in the open state is initially output from the photo-sensor 266, and therefore the mounting time may be accurately calculated.

The distance which the ink cartridge 340 moves for calculating the mounting time is shorter. If the moving distance is shorter, the influence of the variation of the speed at which a user mounts the ink cartridge 340 to the mounting portion 150 also may be reduced, and accordingly the mounting time is calculated accurately. In this embodiment, because the signals output from the photo-sensors 66 and 266 are used for calculating the mounting time, the sensor 170 may be omitted in the mounting portion 150.

In yet still a further embodiment of the third embodiment, the ring-shaped protrusion 51*b* may be longer in the first direction, such that when the ink cartridge 340 is mounted to the mounting portion 150 the first valve 50 may transition to the open state after the second valve 60 transitions to the open state. In this case as well, the mounting time may be a period of time between the time at which the detection signal B indicating that the second vale 60 is in the open state is initially output from the photo-sensor 66 and the time at which the detection signal E indicating that the first valve 50 is in the open state is initially output from the photo-sensor 266.

In still another embodiment, instead of the controller 90, the controller 100 may perform the process performed by the controller 90. More specifically, the controller 100 may perform the process of steps 115 to H7 and steps H9 to 1111 instead of the controller 90. In this case, the controller 90 may be omitted from the ink cartridge 240 or 340.

In another embodiment, instead of the ink cartridge 240 or 340, the main unit of the ink jet printer 1 may comprise the storing portion 125. Also, the storing portion 125 may store different predetermined times, depending on the specifications, e.g., the type or model the main unit of the ink jet printer 1, to which the ink cartridge 240 or 340 is mounted. Specifically, if the length of the path extending from the hollow tube 153 to the discharge nozzles of the ink jet head 2 is longer than a reference length, predetermined times which are shorter than reference predetermined times, respectively, may be stored in the storing portion 125, and if the length of the path extending from the hollow tube 153 to the discharge nozzles of the ink jet head 2 is shorter than the reference length, predetermined times which are longer than reference predetermined times, respectively, may be stored in the storing portion 125.

In another embodiment of the invention, the predetermined times may depend on meniscus withstanding pressure instead of the path length. Specifically, if the diameter of the discharge nozzle of the ink jet head 2 is greater than a reference diameter, e.g., the meniscus withstanding pressure is smaller than a reference withstanding pressure, predetermined times which are shorter than reference predetermined times, respectively, may be stored in the storing portion 125. Similarly, if the diameter of the discharge nozzle of the ink jet head 2 is less than a reference diameter, predetermined times which are longer than reference predetermined times, respectively, may be stored in the storing portion 125.

Selection of the reference predetermined times and the predetermined times may be performed by the controller 100 taking into consideration the specification of the main unit of the ink jet printer 1 is being used. Additionally, the storing portion 125 may store different ink leakage amounts, depending on the specifications of the main unit of the ink jet printer 1 to which the ink cartridge 240 or 340 is mounted.

In yet another modified embodiment, instead of the ink cartridge 240 or 340, the main unit of the ink jet printer 1 may comprise the storing portion 125. Also, the storing portion 125 may store may store coefficients by which the predetermined times already stored in the storing portion 125 multiplied, respectively, depending on the specifications, e.g., models, of the main unit of the ink jet printer 1 to which the ink cartridge 240 or 340 is mounted. Specifically, if the length of the path extending from the hollow tube 153 to the discharge nozzles of the ink jet head 2 is longer than a reference length, coefficients which causes the predetermined times to be shorter than reference predetermined times may be stored in the storing portion 125, and if the length of the path is shorter than the reference length, coefficients which causes the predetermined times to be longer than reference predetermined times may be stored in the storing portion 125.

Moreover, the coefficients may depend on meniscus withstanding pressure instead of the path length. Specifically, if the diameter of the discharge nozzle of the ink jet head 2 is greater than a reference diameter, coefficients which causes the predetermined times to be shorter than reference predetermined times may be stored in the storing portion 125, and if the diameter of the discharge nozzle of the ink jet head 2 is less than a reference diameter, coefficients which causes the predetermined times to be longer than reference predetermined times may be stored in the storing portion 125. Selection of the reference predetermined times and the coefficients may be performed by the controller 100, and controller 100 may take into consideration the specification of the main unit of the ink jet printer 1 that is being used. Additionally, the storing portion 125 may store different ink leakage amounts, depending on the specifications of the main unit of the ink jet printer 1 to which the ink cartridge 240 or 340 is mounted.

Figure 14:
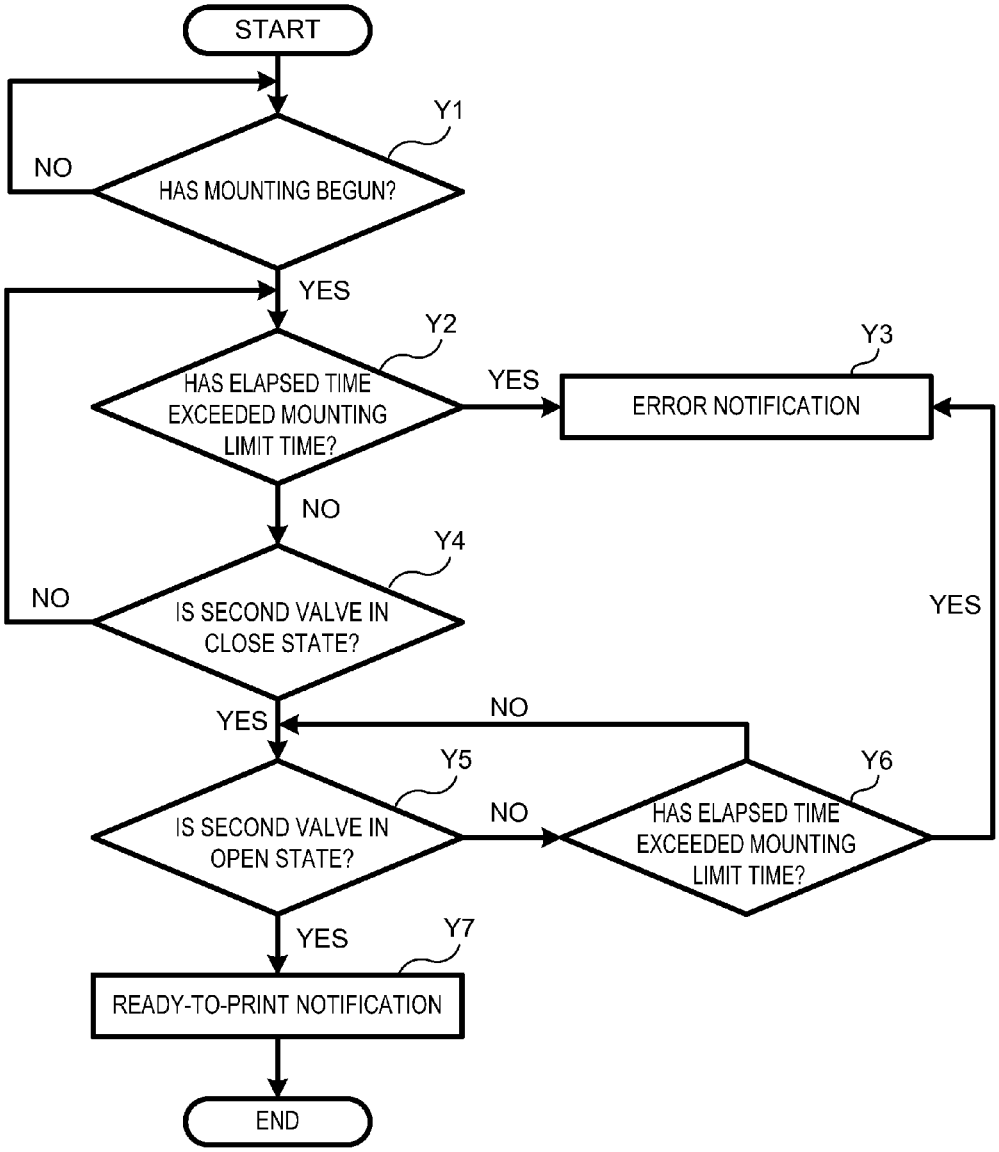
FIG. 14 is a flowchart of control during a mounting the ink cartridge to a mounting portion, according to a still another embodiment of the invention.

FIG. 14 illustrates processes performed by the controller 100 according to a still yet another further embodiment of the invention when the ink cartridge 40 is mounted to the mounting portion 150. Note that components which are the same as or equivalent to those in the first embodiment will be denoted with the same reference numerals and description thereof will be omitted.

When the ink cartridge 40 is intended to be mounted to the mounting portion 150, in Step Y1, the controller 100 may determines whether mounting of the ink cartridges 40 to the mounting portions 150 has begun. This determination is made based on whether or not the controller 100 receives the detection signal C. As described above, the signal output from the sensor 170 changes from the detection signal D to the detection signal C, when the detecting portion 171 of the sensor 170 comes into contact with the housing 41. When the controller 100 does not receive the detection signal C from the sensor 170 but rather receives the detection signal D, the controller 100 determines that the mounting has not begun yet, e.g., "NO" at Step Y1, and stands by, e.g., repeats Step Y1. When the controller 100 receives the detection signal C from the sensor 170, the controller 100 determines that the mounting has begun, and the processing proceeds to Step Y2.

In Step. Y2, the controller 100 determines whether or not amounting limit time has expired since the controller 100 initially receives the detection signal C, e.g., since the controller 100 determines that the mounting has begun at Y1. This determination is made based on whether the time elapsed since the controller 100 initially receives the detection signal C at Y1 has exceeded the mounting limit time stored in a storing portion 120, e.g., as shown in FIG. 8 of the main unit of the ink jet printer 1. If it is determined that the elapsed time has exceeded the mounting limit time, e.g. "YES" at Step Y2, then processing advances to Step Y3. The controller 100 then controls the buzzer 13 to notify the user that "the ink cartridge is not mounted correctly to the mounting portion" with a sound from the buzzer 13. On the other hand, if the elapsed time has not exceeded the mounting limit time, e.g., "NO" at Step Y2, then processing advances to Step Y4.

In Step Y4, the controller 100 may determine whether the second valve 60 is in the dosed state. This determination may be based on whether the controller 100 receives the detection signal A. If the controller 100 receives the detection signal A and determines that the second valve 60 is in the closed state, e.g. "YES" at Step Y4, then processing advances to Step Y5. If the controller 100 does not receive the detection signal A and does not determine that the second valve 60 is in the closed state, e.g., "NO" at Step Y4, then processing returns to step Y2

In Step Y5, the controller 100 may determine whether the second valve 60 is in the open state. This determination may be based on whether the controller 100 receives the detection signal B. As described above, when the valve member 62 moves, such that the photo-sensor 66 and the valve member 62 no longer face each other, the detection signal A, which has been output from the photo-sensor 66, changes to the detection signal B. If the controller 100 does not receive the detection signal B, e.g., continues to receive the detection signal. A and does not determine that the second valve 60 is in the open state, e.g., "NO" at Step Y5, then processing advances to Step Y6, and if the controller 100 receives the detection signal B and determines that the second valve 60 is in the open state, e.g. "YES" at Step Y5, then processing advances to Step Y7.

In Step Y6, the controller 100 may determine whether the mounting limit time has expired because the controller 100 initially receives the detection signal C, e.g., since the controller 100 determines that the mounting has begun at Step Y1, similarly to Step Y2. If it is determined that the elapsed time has exceeded the mounting limit time, e.g. "YES" at Step Y6, then processing moves to Step Y3. The controller 100 then controls the buzzer 13 to notify the user that "the ink cartridge is not mounted correctly to the mounting portion," with a sound from the buzzer 13. On the other hand, if the elapsed time has not exceeded the mounting limit time, e.g. "NO" at Step Y6, processing returns to step Y5.

From the time when the detection signal C starts to be outputted from the sensor 170 until the second valve 60 transitions to the open state, the following occurs. First, during the period of time after the detection signal C starts to be output from the sensor 170 to the controller 100 and before the hollow tube 153 starts to be inserted to the opening 51*a*, the contact 91 and the contact 161 may be electrically connected, and the contact 163 of the electric power output portion 162 and the electric power input portion 92 may be electrically connected. Accordingly, the photo-sensor 66 and the controller 100 may be electrically connected, such that the controller 100 may receive signals output from the photo-sensor 66, and electric power may be supplied to the photo-sensor 66.

Subsequently, as the hollow tube 153 is inserted into the opening 51*a*, the tip of the hollow tube 153 comes into contact with the spherical member 52 and the spherical member 52 moves toward the second valve 60, e.g., to the right in when aligned as shown in FIGS. 7A and 7B), such that the spherical member 52 is separated from the curved portion 51*c* and the ring-shaped protrusion 51*b*, and the state of the first valve 50 transitions from the closed state to the open state. Subsequently, the spherical member 52 may contact with the tip of the pressing member 70 and the pressing member 70, spherical member 52, and valve member 62 move toward the connecting portion 42*a*, e.g., to the right when aligned as shown in FIGS. 7A and 7B. The valve member 62 and the valve seat 61 may be separated from each other, and the state of the second valve 60 may transition from the closed state to the open state. Thus, when the second valve 60 transitions to open state, the contact 91 and the contact 161 are in electrical contact, so the controller 100 may receive the detection signal B output from the photo-sensor 66. The determination of whether the second valve 60 is in the open state in Step Y5 thus also includes the determination of whether the hollow tube 153 has been correctly inserted into the ink cartridge 40. In other words, by the photo-sensor 66 detecting whether the valve member 62 is at a predetermined position, e.g., a position where the valve member 62 is a predetermined distance away from the valve seat 61, the controller 100 may determine whether the hollow tube 153 has been correctly inserted into the ink outlet path 43*a*, and therefore it an ink path may be correctly formed from the ink cartridge 40 to the main unit of the ink jet printer 1, e.g., to the mounting portion 150.

In Step Y7, the controller 100 may control the buzzer 13 to emit a sound from the buzzer 13, indicating "ready to print." Thus, the mounting of the ink cartridge 40 is completed.

When ink stored in the ink cartridge 40 is depleted, the door 1*c* of the ink jet printer 1 is opened and the ink cartridge 40 is removed from the mounting portion 150. As the ink cartridge 40 is moved to be removed, the spherical member 52, valve member 62, and pressing member 70 may move together toward the sealing member 51, e.g., to the left when aligned as shown in FIGS. 7A and 7B while contacting each other, due to the biasing forces of the coil springs 53 and 63. In other words, the spherical member 52, valve member 62, and pressing member 70 move in a direction opposite to a direction in which they move when the hollow tube 153 is inserted into the sealing member 51.

When the valve member 62 comes into contact with the valve seat 61, the state of the second valve 60 changes from the open state to the closed state, and the flow of ink from the ink bag 42 to the inner space 153*a* of the hollow tube 153 stops. At this time, the signal output from the photo-sensor 66 to the controller 100 changes from the detection signal B to the detection signal A, and the controller 100 determines that the second valve 60 is in the closed state.

Subsequently, only the spherical member 52 moves along with the hollow tube 153, such that the spherical member 52 and the tip of the pressing member 70 may be separated. The spherical member 52 then comes into contact with the ring-shaped protrusion 51*b* and curved portion 51*e*, so the state of the first valve 50 transitions from the open state to the closed state. Thus, the state of each of the first and second valves 50 and 60 transitions from the open state to the closed state in accordance with the movement of the hollow tube 153 pulled out of the sealing member 51. The first valve 50 transitions to the closed state after the second valve 60 transitions to the closed state.

After the ink cartridge 40 moves further and the hollow tube 153 is removed from the sealing member 51 completely, the contact between the contact 91 and contact 161, and the contact between the electric power input portion 92 and contact 163, may be cut off. When the housing 41 is separated from the detecting portion 171 and the detecting portion 171 comes out of the sensor 170, the detection signal D is output from the sensor 170 to the controller 100. Accordingly, the controller 100 may determine that the ink cartridge 40 has been removed from the mounting portion. In this way, the old ink cartridge 40 may be removed from the mounting portion 150, and a new ink cartridge 40 may be mounted to the mounting portion 150.

In still another embodiment, a display may be provided on the housing 1*a* instead of the buzzer 13, so as to display images on the display instead of sounds to notify the user. In yet another embodiment, the buzzer and the display may be used together.

In the above-described embodiments, electric power is supplied to the components provided in the ink cartridge, such as the photo-sensors 66 and 266, controller 90, etc. when the ink cartridge is mounted to the mounting portion 150. Nevertheless, in a modified embodiment, the ink cartridge may comprise a battery instead of the electric power input portion 92, and a mechanical switch configured to control, e.g., selectively enable and stop, the supply of electric power from the battery to these components. In this case, the mechanical switch may enable the supply of electric power from the battery to the components by coming into contact with a wall surface of the recess 151 of the mounting portion 150 when the ink cartridge is mounted to the mounting portion 150. When the mechanical switch moves away from the wall, the supply of electric power from the battery to the components is stopped. Also, the mechanical switch is preferably configured to supply electric power from the battery to the components at the same time when the electric power input portion 92 and the electric power output portion 162 are electrically connected. Thus, the same advantages as in the first to third embodiments can be obtained.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid cartridge comprising:

a liquid storing portion configured to store liquid therein;

a liquid outlet path configured to be in fluid communication with the liquid storing portion;

a liquid outlet tube that defines the liquid outlet path therein;

a movable member disposed in the liquid outlet path; and a sensor configured to output a signal relative to a position of the movable member, wherein the liquid outlet path is configured to allow liquid to flow therethrough in a liquid flow direction, wherein the movable member is configured to move from a first position to a second position in a direction parallel to the liquid flow direction, and wherein the movable member is disposed in the liquid outlet tube.

2. The liquid cartridge of claim 1, further comprising a biasing member disposed in the liquid outlet path and configured to bias the movable member.

3. The liquid cartridge of claim 2, wherein the biasing member is configured to bias the movable member toward an end of the liquid outlet path.

4. The liquid cartridge of claim 2, wherein the biasing member is configured to bias the movable member in a biasing direction that is parallel to the liquid flow direction.

5. The liquid cartridge of claim 1, wherein the movable member is configured to move from the second position to the first position in the direction parallel to the liquid flow direction.

6. The liquid cartridge of claim 1, wherein the movable member is configured to move from the first position to the second position in a direction opposite to the liquid flow direction.

7. The liquid cartridge of claim 1, wherein the movable member is configured to slide along an inner wall of the liquid outlet tube.

8. The liquid cartridge of claim 7, wherein the movable member has a cylindrical shape, and the liquid outlet tube has a hollow cylindrical shape.

9. The liquid cartridge of claim 1, further comprising a particular valve configured to selectively place the liquid outlet path in fluid communication with an exterior of the liquid storing portion.

10. The liquid cartridge of claim 9, wherein the particular valve is disposed at the liquid outlet path between the movable member and an exterior of the liquid storing portion.

11. The liquid cartridge of claim 9, wherein the particular valve is disposed at the liquid outlet path and configured to elastically deform and reform to allow and prevent fluid communication between the liquid outlet path and an exterior of the liquid storing portion, respectively.

12. The liquid cartridge of claim 9, wherein the particular valve comprises a sealing member disposed at the liquid outlet path.

13. The liquid cartridge of claim 12, wherein the particular valve further comprises a particular valve member configured to selectively contact the sealing member, and to prevent liquid from flowing through the particular valve when the particular valve member contacts the sealing member.

14. The liquid cartridge of claim 9, wherein the particular valve is disposed at an end of the liquid outlet path.

15. The liquid cartridge of claim 1, further comprising a further valve disposed at the liquid outlet path, and configured to selectively place the liquid outlet path in fluid communication with an exterior of the liquid storing portion, the further valve comprising:

a valve seat disposed at the liquid outlet path, wherein the movable member is configured to selectively contact and move away from the valve seat to close and open the further valve, respectively.

16. The liquid cartridge of claim 15, wherein the further valve further comprises a further biasing member configured to bias the movable member toward the valve seat.

17. The liquid cartridge of claim 15, wherein the sensor is disposed outside the liquid outlet path and aligned with the valve seat of the further valve.

18. The liquid cartridge of claim 1, wherein the sensor is configured to detect the position of the movable member.

19. The liquid cartridge of claim 1, wherein the sensor is disposed outside the liquid outlet path.

20. The liquid cartridge of claim 1, further comprising a contact portion, wherein the sensor is electrically connected to the contact portion.

21. The liquid cartridge of claim 1, wherein the movable member comprises a first end portion and a second end portion opposite to the first end portion, and the first end portion is closer to an interior of the liquid storing portion than the second end portion, and the sensor is configured to face the second end portion of the movable member when the movable member is in the first position, and not to face the second end portion of the movable member when the movable member is in the second position.

22. The liquid cartridge of claim 1, wherein when the movable member is in the first position, the sensor is configured to output a first signal, and when the movable member is in the second position, the sensor is configured to output a second signal different from the first signal.

23. The liquid cartridge of claim 22, wherein the first signal has a greater signal strength than the second signal.

24. The liquid cartridge of claim 23, wherein the first signal corresponds to a high voltage signal, and the second signal corresponds to a low voltage signal.

25. The liquid cartridge of claim 1, wherein the movable member is configured to move between the first position where the movable member is aligned with a center of the sensor in the liquid flow direction and the second position where the movable member is not aligned with a center of the sensor in the liquid flow direction.

26. The liquid cartridge of claim 1, wherein the sensor comprises a photosensitive sensor configured to selectively output a first signal and a second signal based on an intensity of light received at the photosensitive sensor.

27. The liquid cartridge of claim 26, wherein the photosensitive sensor comprises:

a light emitting portion configured to emit light; and a light receiving portion configured to receive light.

28. The liquid cartridge of claim 27, wherein the movable member comprises a reflective surface configured to reflect light.

29. The liquid cartridge of claim 27, wherein the light emitting portion is disposed at a first end of the liquid outlet path, and the light receiving portion is disposed at a second end of the liquid outlet path opposite to the first end in a direction perpendicular to the liquid flow direction, wherein when the movable member is in the first position, the movable member blocks the emitted light from reaching the light receiving portion, and when the movable member is in the second position, the emitted light passes through the liquid outlet path to the light receiving portion.

30. The liquid cartridge of claim 1, wherein the sensor comprises a magnetic sensor configured to selectively output a first signal and a second signal based on a magnetic flux density.

31. The liquid cartridge of claim 30, wherein the magnetic sensor comprises a hall element.

32. The liquid cartridge of claim 30, further comprising an interacting portion configured to magnetically interact with the magnetic sensor to change the magnetic flux density at the magnetic sensor.

33. The liquid cartridge of claim 32, wherein the movable member is the interacting portion.

34. The liquid cartridge of claim 1, further comprising a storing portion configured to store a first stored data corresponding to at least one characteristic of the liquid cartridge.

35. The liquid cartridge of claim 34, wherein the first stored data corresponds to an amount of liquid remaining in the cartridge.

* * * * *